US012140027B2

(12) United States Patent
Pink et al.

(10) Patent No.: US 12,140,027 B2
(45) Date of Patent: Nov. 12, 2024

(54) PARTICLE IMPACT DRILL BITS AND ASSOCIATED METHODS

(71) Applicant: National Oilwell Varco, L.P., Houston, TX (US)

(72) Inventors: Tony P. Pink, Houston, TX (US); Tom S. Roberts, Montgomery, TX (US); Jason R. Cunningham, Spring, TX (US); Richard J. Sauvageau, Conroe, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 17/964,195

(22) Filed: Oct. 12, 2022

(65) Prior Publication Data

US 2023/0133889 A1 May 4, 2023

Related U.S. Application Data

(60) Provisional application No. 63/273,553, filed on Oct. 29, 2021.

(51) Int. Cl.

| | |
|---|---|
| ***E21B 7/18*** | (2006.01) |
| ***E21B 10/26*** | (2006.01) |
| ***E21B 10/60*** | (2006.01) |

(52) U.S. Cl.

CPC ..... *E21B 7/18* (2013.01); *E21B 10/26* (2013.01); *E21B 10/60* (2013.01)

(58) Field of Classification Search

CPC ..... E21B 7/18; E21B 10/26; E21B 10/60

See application file for complete search history.

(56) References Cited

U.S. PATENT DOCUMENTS

| | | | | |
|---|---|---|---|---|
| 3,469,642 | A * | 9/1969 | Goodwin | E21B 10/60 175/393 |
| 6,926,099 | B2 * | 8/2005 | Thigpen | E21B 10/265 175/391 |
| 2006/0021801 | A1 * | 2/2006 | Hughes | E21B 10/64 175/398 |
| 2010/0320005 | A1 * | 12/2010 | Burhan | E21B 10/55 175/425 |
| 2016/0290067 | A1 * | 10/2016 | Tipples | E21B 17/1078 |

FOREIGN PATENT DOCUMENTS

CN 106812469 A * 6/2017

OTHER PUBLICATIONS

Han et al., Chinese Patent No. 106812469 A, English translation, Dec. 1, 2023 (Year: 2023).*

* cited by examiner

*Primary Examiner* — Caroline N Butcher
(74) *Attorney, Agent, or Firm* — Conley Rose, P.C.

(57) ABSTRACT

A particle impact drill bit for a well system includes a central axis, a longitudinal first end, a longitudinal second end opposite the first end, and a feed passage extending into the drill bit from the first end, a pilot section located at the second end, the pilot section including one or more converging nozzles in fluid communication with the feed passage, and a reamer section located between the first end and the second end and including one or more reamer blades extending radially outwards from the central axis of the drill bit, and wherein the reamer section defines a maximum width of the drill bit.

23 Claims, 17 Drawing Sheets

PARTICLE IMPACT DRILL BITS AND ASSOCIATED METHODS

CROSS-REFERENCE TO RELATED APPLICATIONS

This application claims benefit of U.S. provisional patent application Ser. No. 63/273,553 filed Oct. 29, 2021, and entitled "Particle Impact Drill Bits and Associated Methods," which is hereby incorporated herein by reference in its entirety for all purposes.

STATEMENT REGARDING FEDERALLY SPONSORED RESEARCH OR DEVELOPMENT

Not applicable.

BACKGROUND

In drilling a borehole into an earthen formation, such as for the recovery of hydrocarbons or minerals from a subsurface formation, it is typical practice to connect a drill bit onto the lower end of a drillstring formed from a plurality of pipe joints connected together end-to-end, and then rotate the drillstring so that the drill bit progresses downward into the earth to create a borehole along a predetermined trajectory. In vertical drilling operations, the drillstring and drill bit are typically rotated from the surface with a top dive or rotary table. Drilling fluid or "mud" is typically pumped under pressure down the drillstring, out the face of the drill bit into the borehole, and then up the annulus between the drillstring and the borehole sidewall to the surface. The drilling fluid, which may be water-based or oil-based, is typically viscous to enhance its ability to carry borehole cuttings to the surface.

SUMMARY

An embodiment of a particle impact drill bit for a well system comprises a central axis, a longitudinal first end, a longitudinal second end opposite the first end, and a feed passage extending into the drill bit from the first end, a pilot section located at the second end, the pilot section comprising one or more converging nozzles in fluid communication with the feed passage, and a reamer section located between the first end and the second end and comprising one or more reamer blades extending radially outwards from the central axis of the drill bit, and wherein the reamer section defines a maximum width of the drill bit. In some embodiments, the drill bit comprises a monolithically formed body which includes both the pilot section and the reamer section. In some embodiments, the drill bit comprises a connector located at the second end of the drill bit. In certain embodiments, at least one of the converging nozzles has a maximum length that is greater than a maximum width of the converging nozzle. In certain embodiments, at least one of the converging nozzles has a tapered central passage comprising a taper length which is greater than a maximum width of the converging nozzle. In some embodiments, the pilot section comprises a first body formed from a first material and the reamer section comprises a second body formed from a second material, and wherein the first material has a greater hardness than the second material. In some embodiments, the reamer section comprises a first reamer section and the one or more reamer blades comprises one or more first reamer blades, and wherein the drill bit further comprises a second reamer section located between the first reamer section and the second reamer section and comprising one or more second reamer blades extending radially outwards from the central axis of the drill bit. In some embodiments, the one or more nozzles of the pilot section comprise one or more first nozzles and the second reamer section comprises one or more second converging nozzles in fluid communication with the feed passage and axially spaced from the one or more first converging nozzles. In certain embodiments, at least one of the one or more first converging nozzles is oriented at an obtuse angle relative to at least one of the one or more second converging nozzles. In certain embodiments, the drill bit comprises a first lateral side and a second lateral side opposite the first lateral side, and wherein the one or more reamer blades of the reamer section are positioned only on the first lateral side of the drill bit. In some embodiments, the one or more nozzles of the pilot section comprise one or more first nozzles and the reamer section comprises one or more second converging nozzles in fluid communication with the feed passage and axially spaced from the one or more first converging nozzles. In some embodiments, the reamer section comprises a first reamer section and the one or more reamer blades comprises one or more first reamer blades, and wherein the drill bit further comprises a second reamer section located between the first reamer section and the second reamer section and comprising one or more second reamer blades extending radially outwards from the central axis of the drill bit.

An embodiment of a well system comprising a drilling rig, a drill string extending from the drilling rig into a borehole extending through a subterranean earthen formation, a surface pump configured to pump a drilling fluid through the drill string, wherein the drilling fluid comprises a plurality of solid impactors, and a particle impact drill bit coupled to an end of the drill string, wherein the drill bit comprises a pilot section comprising one or more converging nozzles each configured to emit a jet of the drilling fluid, and a reamer section comprising one or more reamer blades extending radially outwards from a central axis of the drill bit. In some embodiments, the pilot section of the drill bit comprises a first body formed from a first material and the reamer section comprises a second body formed from a second material, and wherein the first material has a greater hardness than the second material. In some embodiments, at least one of the converging nozzles of the drill bit has a tapered central passage comprising a taper length which is greater than a maximum width of the converging nozzle. In certain embodiments, the pilot section comprises a first body formed from a first material and the reamer section comprises a second body formed from a second material, and wherein the first material has a greater hardness than the second material. In certain embodiments, the reamer section of the drill bit comprises a first reamer section and the one or more reamer blades comprises one or more first reamer blades, and wherein the drill bit further comprises a second reamer section located between the first reamer section and the second reamer section and comprising one or more second reamer blades extending radially outwards from the central axis of the drill bit. In some embodiments, the one or more nozzles of the pilot section of the drill bit comprise one or more first nozzles and the second reamer section comprises one or more second converging nozzles axially spaced from the one or more first converging nozzles. In some embodiments, the one or more nozzles of the pilot section comprise one or more first nozzles and the reamer section comprises one or more second converging nozzles axially spaced from the one or more first converging nozzles.

An embodiment of a method for forming a borehole extending through a subterranean earthen formation comprises (a) pumping a drilling fluid comprising a plurality of solid impactors into a particle impact drill bit located within the borehole, (b) ejecting the drilling fluid as a jet from a converging nozzle of a pilot section of the drill bit whereby the jet impacts a terminal end of the borehole, and (c) expanding the borehole by a reamer section of the drill bit whereby the pilot section of the drill bit is spaced from the terminal end of the borehole as the jet impacts the terminal end of the borehole. In some embodiments, the method comprises (d) ejecting the drilling fluid as a jet from a converging nozzle of the reamer section of the drill bit whereby the jet impacts a sidewall of the borehole. In some embodiments, the reamer section comprises a first reamer section of the drill bit, and the method comprises (d) expanding the borehole by a second reamer section of the drill bit that is axially spaced from the first reamer section and which defines a maximum outer diameter of the drill bit. In certain embodiments, the method comprises (e) ejecting the drilling fluid as a jet from a converging nozzle of the second reamer section of the drill bit whereby the jet impacts a sidewall of the borehole.

An embodiment of a particle impact drill bit for a well system comprises a central axis, a longitudinal first end, a longitudinal second end opposite the first end, and a feed passage extending into the drill bit from the first end, one or more first converging nozzles in fluid communication with the feed passage, and one or more second converging nozzles in fluid communication with the feed passage and axially spaced from the one or more first converging nozzles, wherein at least one of the one or more first converging nozzles is oriented at an obtuse angle relative to at least one of the one or more second converging nozzles.

BRIEF DESCRIPTION OF THE DRAWINGS

For a detailed description of exemplary embodiments of the disclosure, reference will now be made to the accompanying drawings in which.

DETAILED DESCRIPTION

Figure 1:
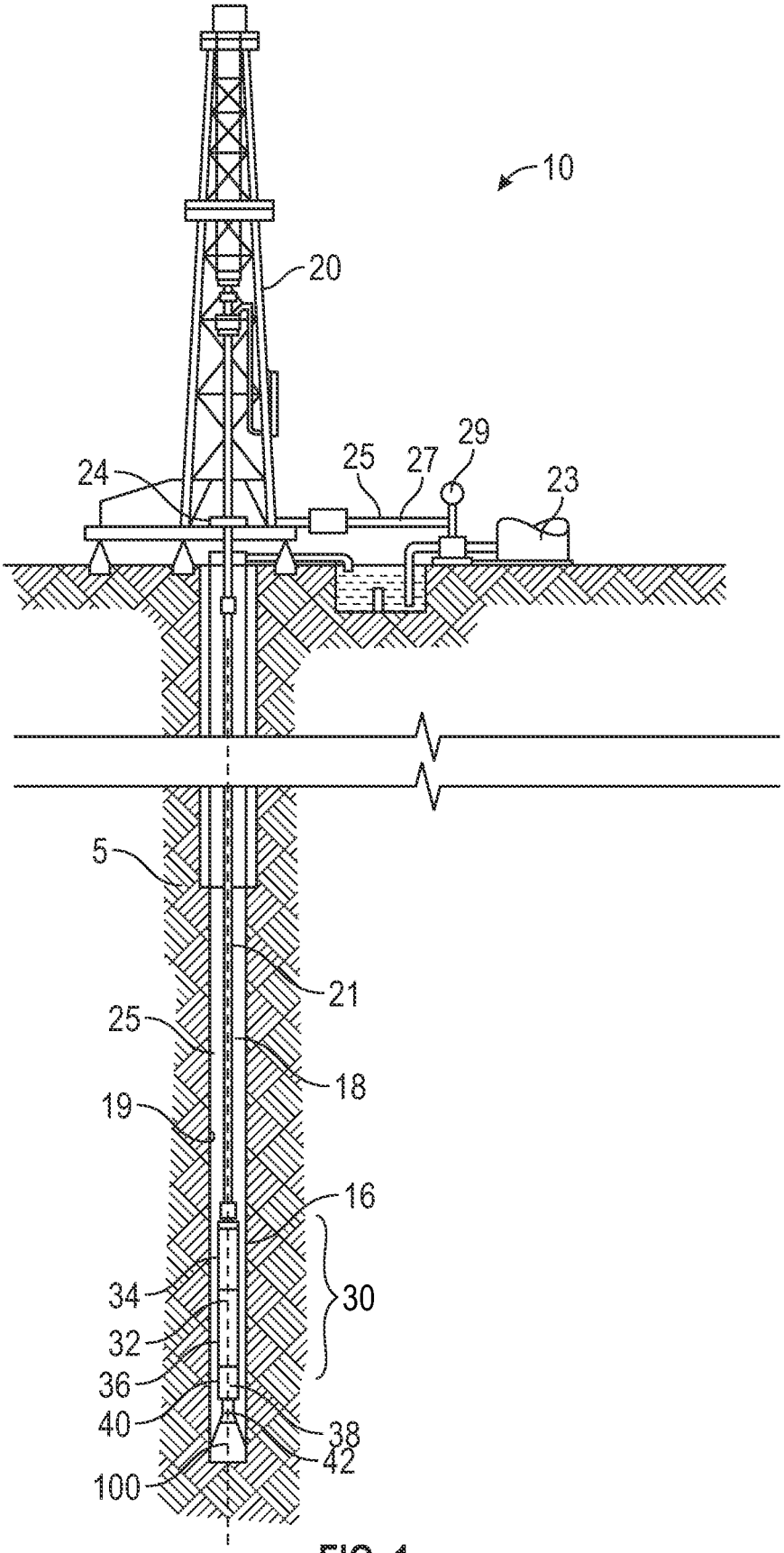
FIG. 1 is a schematic partial cross-sectional view of a drilling system including an embodiment of a particle impact drill bit.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

As described above, well systems may be utilized for forming boreholes in earthen formations via a drill bit of the well system which cuts into the earthen formation to extend the borehole through the formation. Drill bits may include one or more cutting elements for mechanically cutting into the earthen formation. Alternatively, some drill bits, sometimes referred to as "particle flow" or "particle impact" drill bits fluidically rather than mechanically cut into the earthen formation by producing a jet of solid impactors directed against the earthen formation to thereby fracture and/or distress the earthen formation. The impactors may comprise hardened pellets or shot which are ejected from the particle impact drill bit at a high velocity against the earthen formation.

While particle impact drill bits may address some issues associated with conventional drill bits (e.g., wear of the cutting elements of the conventional drill bit), other challenges are presented by particle impact drill bits. For example, particle impact drill bits may produce an uneven a borehole having an uneven sidewall such that torsional and lateral stability typically provided to the drill bit by the sidewall is lost. Additionally, given that no weight-on-bit (WOB) is required in operating particle impact drill bits it may be difficult to determine from the surface where the drill bit is located relative to a terminal end or bottom of the borehole resulting in potentially damaging impacts between the particle impact drill bit and the terminal end of the borehole. Further, the particle impact drill bit may become worn or damaged by the ricocheting of the impactors when, for example, the particle impact drill bit is positioned directly adjacent the terminal end of the borehole.

Accordingly, embodiments of particle impact drill bits are described herein which provide a borehole having a relatively consistent and even sidewall such that WOB may be applied to the drill bit in a manner that allows the WOB and associated reactive torque applied to the drill bit to be monitored from the surface. Embodiments of particle impact drill bits disclosed herein also allow the drill bit to be spaced from the terminal end of the borehole when in operation to thereby minimize wear and damage to the drill bit from the ricocheting of the impactors against the drill bit. Particularly, embodiments of particle impact drill bits disclosed herein include a reamer or reamer section incorporated into the drill bit to stabilize the drill bit during operation. The reamer section of the particle impact drill bit may expand an inner diameter by of the borehole by mechanically cutting into the portion of the borehole fractured and/or distressed by the jets of particle impactors, thereby providing the borehole with a relatively consistent and even sidewall. Additionally, the reamer section may form a shoulder along the sidewall such that WOB may be applied to the particle impact drill bit through the reamer section, the sidewall of the borehole applying reactive force and torque to the reamer section of the drill bit.

Referring to FIG. 1, an embodiment of a well or drilling system 10 is shown. Well system 10 is generally configured for drilling a borehole 16 in a subterranean earthen formation 5. In the embodiment of FIG. 1, well system 10 includes a drilling rig 20 disposed at the surface, a drillstring 21 extending downhole from rig 20, a bottomhole assembly (BHA) 30 coupled to the lower end of drillstring 21, and a drill bit 100 attached to the lower end of BHA 30. A surface or mud pump 23 is positioned at the surface and is configured to pump drilling fluid or mud 25 through drillstring 21. In this exemplary embodiment, drilling fluid 25 comprises a slurry including a plurality if solid impactors 27 supplied by an impactor injector 29 of well system 10 located at the surface. As will be described further herein, drill bit 100 comprises a particle impact drill bit 100 configured to form borehole 16 through bombarding or impacting the formation 5 with the impactors contained in drilling fluid 25. The impactors 27 of drilling fluid 25 may comprise a metallic material such as, for example, hardened steel shot or pellets. However, in other embodiments, the impactors 27 of drilling fluid 25 may comprise other types of solid pellets having a relatively high hardness.

Additionally, rig 20 includes a rotary system 24 for imparting torque to an upper end of drillstring 21 to thereby rotate drillstring 21 in borehole 16. In this embodiment, rotary system 24 comprises a rotary table located at a rig floor of rig 20; however, in other embodiments, rotary system 24 may comprise other systems for imparting rotary motion to drillstring 21, such as a rotary table or top drive. In this exemplary embodiment, a downhole motor 32 is provided in BHA 30 for facilitating the drilling of deviated portions of borehole 16. Moving downward along BHA 30, downhole motor 32 includes a hydraulic drive or power section 34, a driveshaft assembly 36, and a bearing assembly 38. In some embodiments, the portion of BHA 30 disposed between drillstring 21 and downhole motor 32 can include other components, such as drill collars, measurement-while-drilling (MWD) tools, reamers, stabilizers and the like. Additionally, in some embodiments, BHA 30 may not include downhole motor 32.

Power section 34 of downhole motor 32 converts the fluid pressure of the drilling fluid 25 pumped downward through drillstring 21 into rotational torque for driving the rotation of drill bit 100. Particularly, power section 34 comprises a stator coupled to the drillstring 21 and a rotor rotatably positioned within the stator. Driveshaft assembly 36 comprises a driveshaft housing coupled to the stator of power section 34 and a driveshaft rotatably positioned within the driveshaft housing and coupled to the rotor of power section 34. Additionally, bearing assembly 38 comprises a bearing housing 40 coupled to the driveshaft housing and a bearing mandrel 42 rotatably disposed in the bearing housing 40, where the bearing mandrel 42 is coupled between the drill bit 100 and the driveshaft of driveshaft assembly 36. In this configuration, driveshaft assembly 36 and bearing assembly 38 transfer the torque generated in power section 34 to drill bit 100. Particularly, torque applied to the rotor of power section 34 by the drilling fluid 25 pumped down through the drillstring 21 is transmitted to the drill bit 100 via the driveshaft of driveshaft assembly 36 and bearing mandrel 42 connected therebetween.

With force or weight applied to the drill bit 100 by the drillstring 21 and BHA 30, also referred to as WOB, the rotating drill bit 100 engages the earthen formation 5 and proceeds to form borehole 16 along a predetermined path toward a target zone. The drilling fluid 25 pumped down the drillstring 21 and through BHA 30 from surface pump 23 passes out of the face of drill bit 100 and back up the annulus 18 formed between drillstring 21 and the sidewall 19 of borehole 16. The drilling fluid 25 cools the drill bit 100, and flushes the cuttings away from the face of drill bit 100 and carries the cuttings to the surface. In other embodiments, drill bit 100 may engage the earthen formation 5 to form borehole 16 without being rotated either by the downhole motor 32 or via rotation of the drillstring 21 from the surface.

Figure 2:
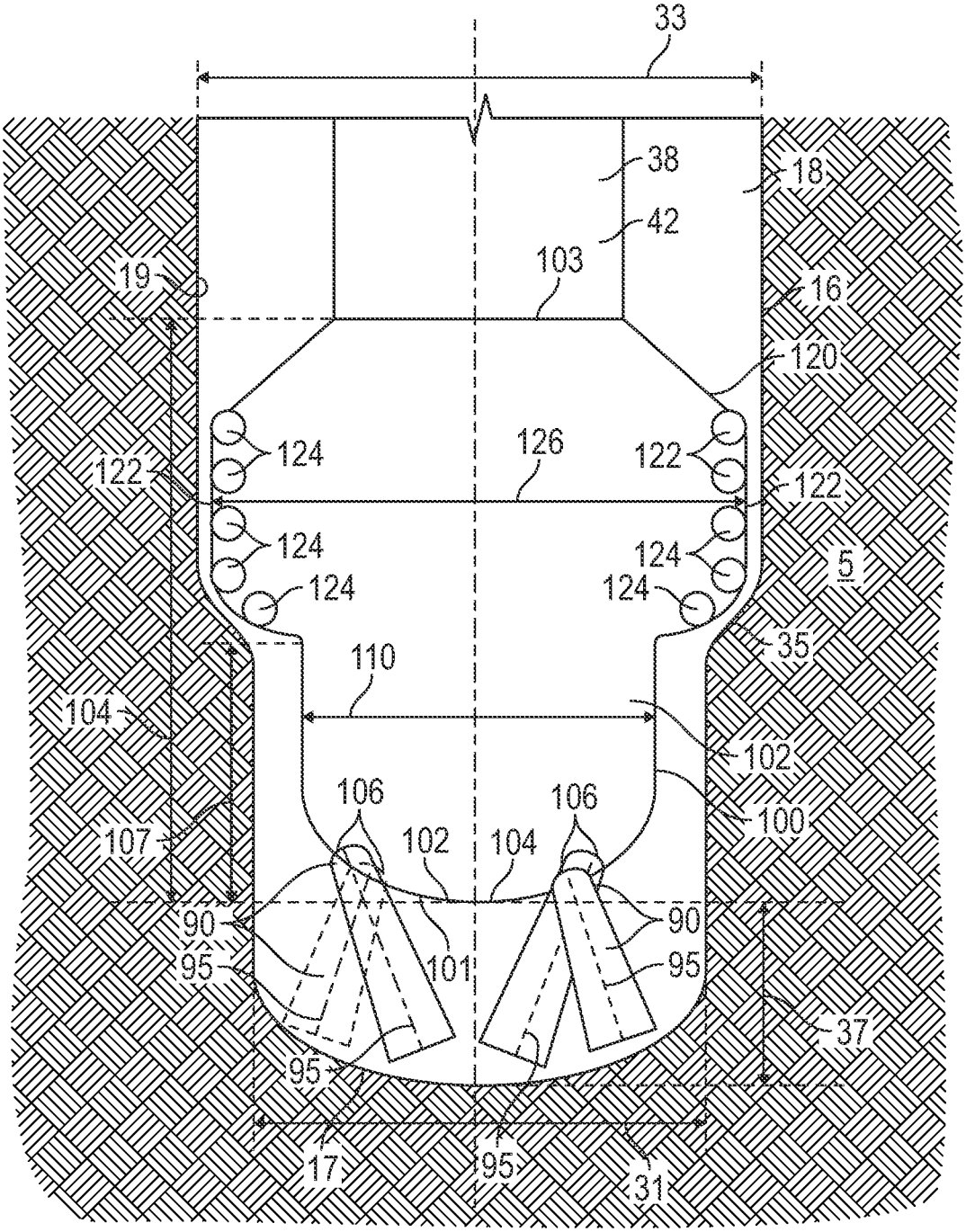
FIG. 2 is an enlarged schematic view of the particle impact drill bit of FIG. 1.
Figure 3:
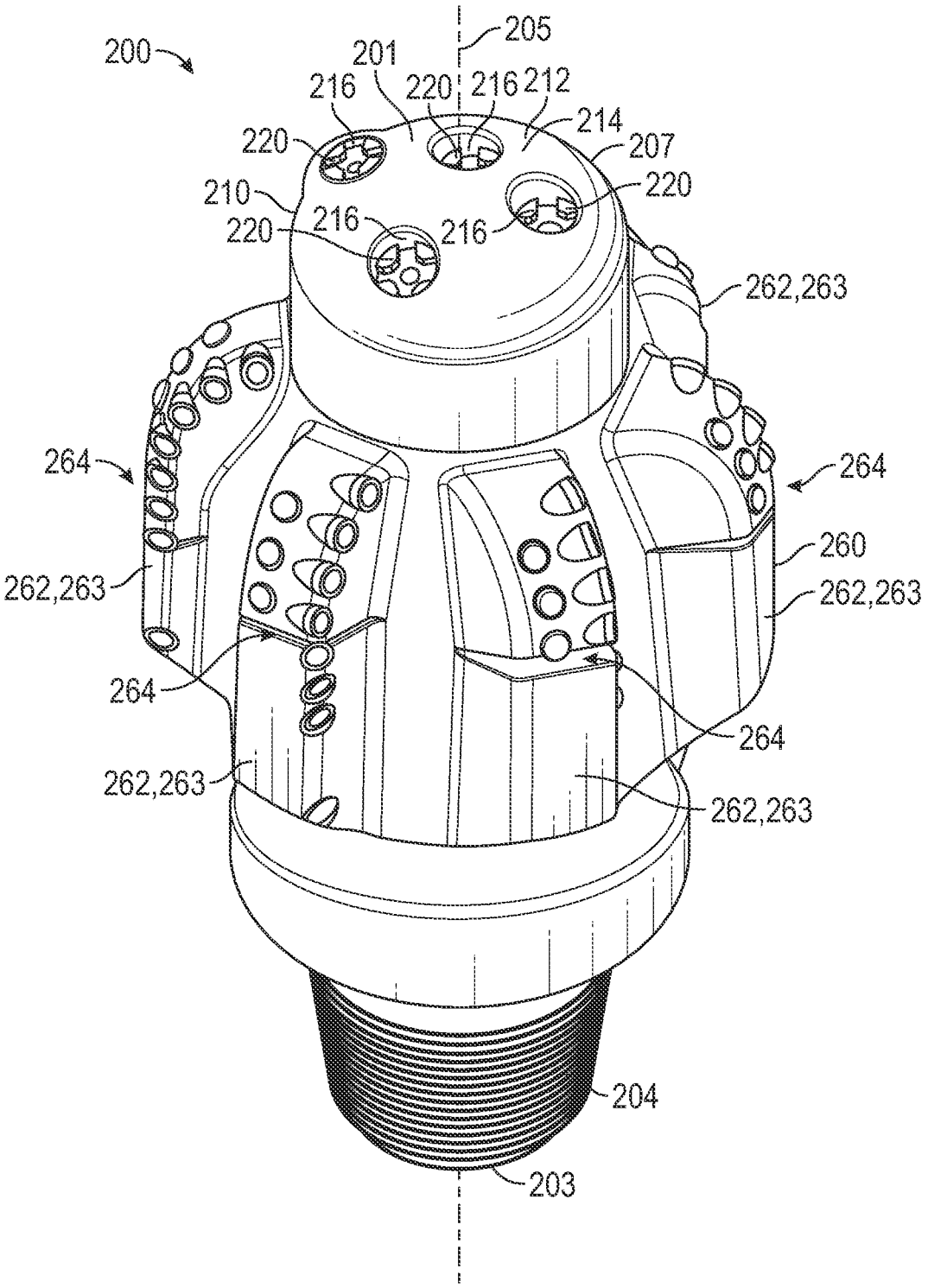
FIG. 3 is a perspective view of another embodiment of a particle impact drill bit.
Figure 4:
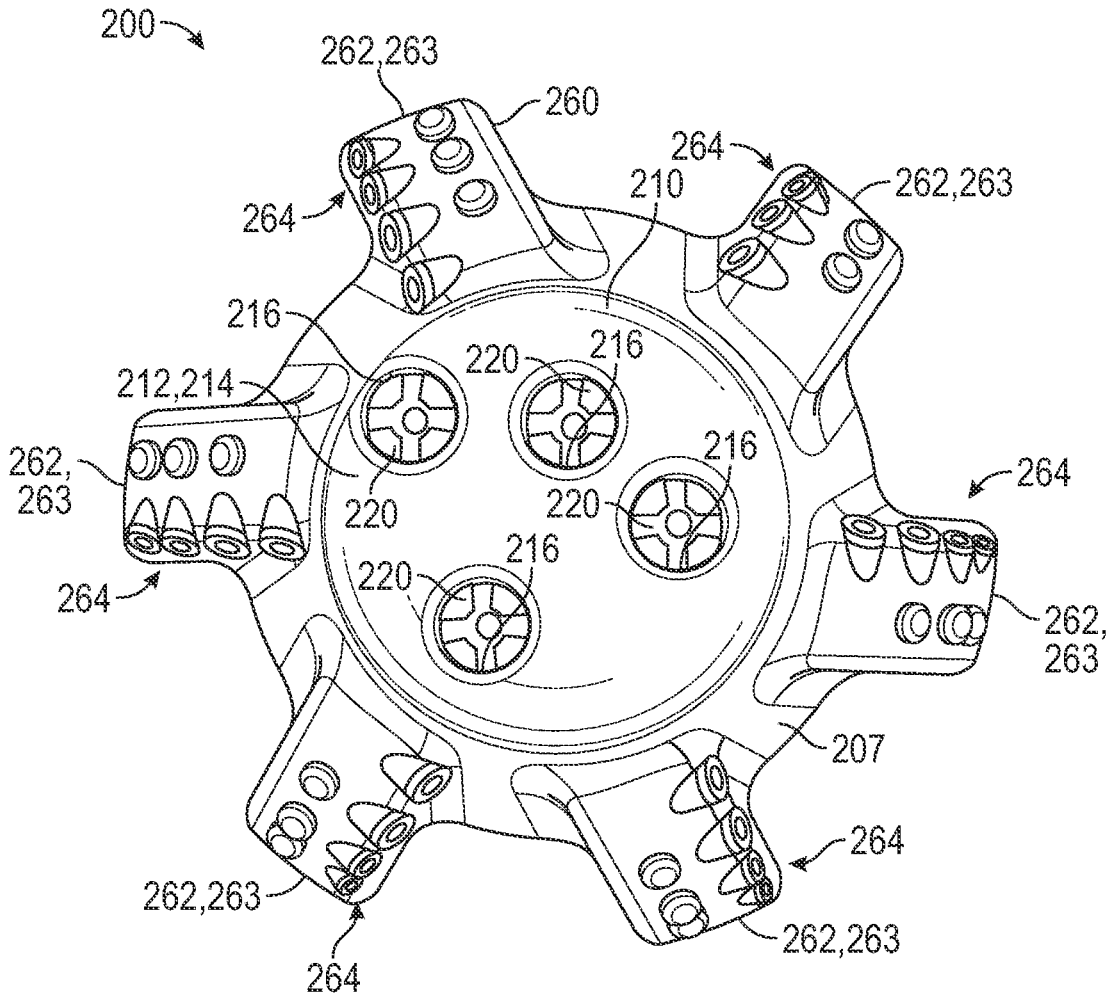
FIG. 4 is a bottom view of the particle impact drill bit of FIG. 3.

Referring to FIG. 2, an enlarged schematic view of the drill bit 100 within borehole 16 is shown. As described above, in this exemplary embodiment, drill bit 100 comprises a particle impact drill bit 100 configured to direct one or more jets 90 of drilling fluid 25 against a terminal end 17 of borehole 16 whereby the impactors 27 contained within jets 90 bombard, fracture and erode the portion of the earthen formation 5 defining the terminal end 17 of borehole 16. In other words, drill bit 100 is configured to fluidically fracture (via the impactors 27) rather than mechanically cut into the terminal end 17 of borehole 16.

Drill bit 100 has a central or longitudinal axis 105, a longitudinal first end 101, and a longitudinal second end 103 opposite the first end 101. The drill bit 100 may include a connector (not shown in FIG. 2) located at second end 103 for connecting drill bit 100 with a terminal end of the bearing mandrel 42 of bearing assembly 38. In this exemplary embodiment, drill bit 100 comprises a pilot section 102 located at the first end 101 and a reamer section 120 positioned between the pilot section 102 and the second end 103. Pilot section 102 generally includes a nose 104 and a plurality of nozzles 106 positioned on and/or within nose 104 and which are configured to produce jets 90. Particularly, nozzles 106 receive the impactor 27 containing drilling fluid 25 pumped through the drillstring 21 and increase a flow velocity of the drilling fluid 25 as the drilling fluid 25 flows through the nozzles 106. The increase in velocity imparted to the drilling fluid 25 by nozzles 106 increases the impact energy between the impactors 27 and the earthen formation 5, thereby permitting the impactors 27 to fracture and/or destress the earthen formation 5 defining the terminal end 17 of borehole 16. Each nozzle 106 is configured to produce a corresponding jet 90 of drilling fluid 25 along a predefined jet axis 95. In some embodiments, the jet 90 of drilling fluid 25 may travel at a velocity between approximately 300 feet per second (ft/sec) and 700 ft/sec to provide approximately between eight million impacts of the impactors 27 per minute and twenty million impacts per minute; however, in other embodiments, the fluid velocity of jets 90 and the number of impacts per minute of impactors 27 may vary.

The jet axis 95 of one or more of the jets 90 of drilling fluid 25 may be at a non-zero angle relative to the central axis 105 of drill bit 100. In some embodiments, the nozzles 106 are arranged and oriented along nose 104 to produce a cross-over pattern of jets 90 of drilling fluid 25 extending from the drill bit 100. In this arrangement, one or more jets 90 of drilling fluid 25 extend radially outwards from central axis 105 while one or more other jets 90 of drilling fluid 2 extend radially towards central axis 105 to thereby intersect or overlap with other jets 90. In this manner, a broad area of the terminal end 17 of borehole 16 may be impacted by the impactors 27 conveyed along the jets 90 extending from drill bit 100. However, it may be understood that the number, arrangement along nose 104, and orientation of nozzles 106 may vary to produce a variety of spray patterns of jets 90 depending on the given application.

In this exemplary embodiment, reamer section 120 of drill bit 100 generally comprises a reamer including a plurality of circumferentially spaced reamer blades 122 which extend radially outwards from the central axis 105 of drill bit 100. Each reamer blade 122 of reamer section 120 comprises one or more engagement or cutting members 124 positioned along an outer surface 123 of the reamer blade 122 and configured to mechanically engage or contact a sidewall 19 of the borehole 16. In this exemplary embodiment, cutting members 124 are distinct from the reamer blade 122 itself and comprise a Polycrystalline Diamond Compact (PDC) material. However, in other embodiments, the material comprising each cutting member 124 may vary. In still other embodiments, cutting members 124 may be formed integrally and monolithically with the reamer blade 122. In other embodiments, reamer section 120 may comprise a roller or roller cone reamer in which reamer blades 122 would comprise rollers (e.g., cone shaped rollers) upon which cutting members would be positioned. Thus, in some embodiments, reamer blades 122 may comprise members which are separate from a body of reamer section 120 and may pivot or rotate relative to the body of reamer section 120 during operation. Additionally, in this exemplary embodiment, reamer section 120 is concentric with respect to pilot section 102; however, in other embodiments, reamer section 120 may be bi-centric or eccentric.

Pilot section 102 of drill bit 100 is configured to fluidically fracture the earthen formation 5 defining the terminal end 17 of borehole 16 via the plurality of jets 90 of drilling fluid 25 while reamer section 120 of drill bit 100 is configured to mechanically expand and complete the borehole 16 to a desired diameter via the reamer blades 122 as the drill bit 100 penetrates into the earthen formation 5. Accordingly, pilot section 102 of drill bit 100 has a maximum outer diameter 110 which is less than a maximum outer diameter 126 of reamer section 120 (defined by the reamer blades 122 of reamer section 120). In this manner, the maximum outer diameter 126 of reamer section 120 defines an overall maximum diameter of the drill bit 100. In some embodiments, a ratio of the maximum outer diameter 126 of reamer section 120 to the maximum outer diameter 110 of pilot section 102 may range approximately between 1.1:1 to 2.0:1; however, in other embodiments the ratio of the maximum outer diameter 126 of reamer section 120 to the maximum outer diameter 110 of pilot section 102 may vary.

Given the difference in maximum outer diameter between pilot section 102 and reamer section 120, as drill bit 100 penetrates into earthen formation 5 to form borehole 16, borehole 16 is initially formed by the pilot section 102 of drill bit 100 at an initial diameter 31. As the drill bit 100 continues to penetrate into earthen formation 5, the initial diameter of the newly formed section of borehole 16 is expanded to a second diameter 33 which is greater than the initial diameter 31. In some embodiments, a ratio of the initial diameter 31 to the expanded diameter 33 of borehole 16 may range approximately between 1.1:1 to 1.5:1. In some embodiments, the ratio of the initial diameter 31 to the expanded diameter 33 of borehole 16 may be less than 1.1:1. Additionally, it may be understood that in other embodiments the ratio of the initial diameter 31 to the expanded diameter 33 may vary.

The difference in diameter between the initial diameter 31 and expanded diameter 33 of borehole 16 forms an annular shoulder 35 along the sidewall 19 of borehole 16 which is engaged by the reamer section 120 of drill bit 100. Particularly, during operation of well system 10, WOB may be applied to drill bit 100 by the drillstring 21 and BHA 30 via the contact that occurs between the reamer section 120 of drill bit 100 and the shoulder 35 of borehole 16. This WOB applied to drill bit 100 may be monitored at the surface by personnel of well system 10 to assist in controlling the operation and performance of drill bit 100. Similarly, contact between the reamer section 120 and the sidewall 19 of borehole 16 allows for reactive torque applied to drill bit 100 by the sidewall 19 to also be monitored at the surface by personnel of well system 10 to further assist in controlling the operation and performance of drill bit 100.

In addition, contact between the shoulder 35 of borehole 16 and the reamer section 120 of drill bit 100 suspends drill bit 100 within borehole 16 whereby a longitudinal distance 37 extends between the first end 101 of drill bit 100 and the terminal end 17 of borehole 16. In other words, contact between the shoulder 35 of borehole 16 and the reamer section 120 of drill bit 100 prevents the first end 101 of drill bit 100 from contacting the terminal end 17 of the borehole 16. The longitudinal distance 37 separating the drill bit 100 from the terminal end 17 of borehole 16 may reduce or mitigate damage occurring to drill bit 100 from the ricocheting of impactors 27 as the impactors 27 collide against the terminal end 17 of borehole 16. Particularly, spacing the first end 101 of the drill bit 100 by the longitudinal distance 37 from the terminal end 17 of borehole 16 may shield the reamer section 120 from ricocheting of the impactors 27 and thus confine exposure to ricocheting impactors 27 to the pilot section 102. In some embodiments, the pilot section 102 may thus be formed from a hardened, impact resistant material to weather ricocheting of the impactors 27 while the reamer section 120 may be made from a different, lower cost material.

In some embodiments, the longitudinal distance 37 may be controlled or at least influenced by varying a longitudinal length 107 of the pilot section 102 relative to an overall longitudinal length 109 of the drill bit 100. Particularly, the longitudinal distance 37 may be increased by reducing the longitudinal length 107 of the pilot section 102 relative to the overall length 209 of the drill bit 100. In some embodiments, the longitudinal distance may be three inches or greater; however, it may be understood that the longitudinal distance 37 may vary significantly depending on the given application.

Referring to FIGS. 3-6, another embodiment of a particle impact drill bit 200 is shown. Drill bit 200 may be utilized in well system 10 in lieu of the drill bit 100 shown in FIG. 2. Alternatively, drill bit 200 may be utilized in well systems other than the well system 10 shown in FIG. 1. Drill bit 200 has a central or longitudinal axis 205, a longitudinal first end 201, and a longitudinal second end 203 opposite the first end 201. Drill bit 200 includes a connector 204 located at the second end 203 of drill bit 200 for connecting drill bit 200 with a bearing mandrel or other tubular member of a well system. In this exemplary embodiment, connector 204 comprises an external threaded connector, however, it may be understood that the configuration of connector 204 may vary.

In this exemplary embodiment, drill bit 200 includes an integral or monolithic body 207 comprising a pilot section 210 located at the first end 201 and a reamer section 260 positioned between the pilot section 210 and the second end 203. Connector 204 is separate and distinct from body 207 in this exemplary embodiment; however, in other embodiments, connector 204 may also be formed integrally and monolithically with body 207. In this exemplary embodiment, the body 207 of drill bit 200 comprises a matrix material such as, for example, a matrix carbide material. In other embodiments, body 207 may comprise a cast material such as, for example, a cast carbide material. In still other embodiments, the materials comprising body 207 and the method for forming body 207 may vary. In some embodiments, pilot section 210 may comprise a solid carbide, Satellite, or other material created through an additive manufacturing process. For example, pilot section 210 may be manufactured using a directed energy deposition (DED) or other form of laser metal deposition under additive manufacturing. In some embodiments, pilot section 210 may be manufactured using a laser metal deposition process using metal wire, power, and/or ceramics to form pilot section 210. In some embodiments, the one or more nozzles of pilot section 210 may be formed integrally and monolithically with the body forming pilot section 210. For example, the nozzles may be printed into the body forming pilot section 210 in embodiments where pilot section 210 is constructed using an additive manufacturing process.

Although in this exemplary embodiment both reamer section 260 and pilot section 210 are part of the same body 207, in other embodiments, reamer section 260 and pilot section 210 may comprise separate components which are joined to form drill bit 200. Particularly, given that reamer section 260 is shielded from at least some of the ricocheting impactors 27 as described above with respect to drill bit 100, in some embodiments, pilot section 210 may comprise a material which has a greater hardness and/or resistance to wear than the material comprising reamer section 260. In this manner, the cost of the materials comprising drill bit 200 may be minimized. For example, drill bit 200 may comprise a first body formed from a first material and comprising the pilot section 210, and a second body formed from a second material and comprising the reamer section 260, wherein the first material has a greater hardness and wear resistance than the second material.

In this exemplary embodiment, the pilot section 210 of drill bit 200 comprises an externally curved nose 212 and a plurality of receptacles 216 extending through the nose 212 of pilot section 210. In this exemplary embodiment, nose 212 is defined by convex outer surface 214 having a bullet or teardrop shape. The convex outer surface 214 of nose 212 may assist in directing the recirculation of drilling fluid 25 upwards through borehole 16 after the drilling fluid 25 has been ejected from drill bit 200.

Each receptacle 216 of pilot section 210 receives a nozzle assembly 220 therein for accelerating a flow of drilling fluid 25 therethrough such that a high-velocity jet of drilling fluid 25 (containing impactors 27) is ejected from the nozzle assembly 220 against the terminal end 17 of borehole 16 to thereby fracture or destress the earthen formation 5 defining terminal end 17. In this exemplary embodiment, pilot section 210 comprises a plurality of the receptacles 216 and corresponding nozzle assemblies 220 arranged in a cross-over pattern; however, it may be understood that the number and/or arrangement of nozzle assemblies 220 may vary. Nozzle assemblies 220 are separate from the body 207 of drill bit 200 and thus may be formed from materials that vary in composition and/or method of manufacture than the material(s) comprising body 207, as will be described further herein.

Figure 7:
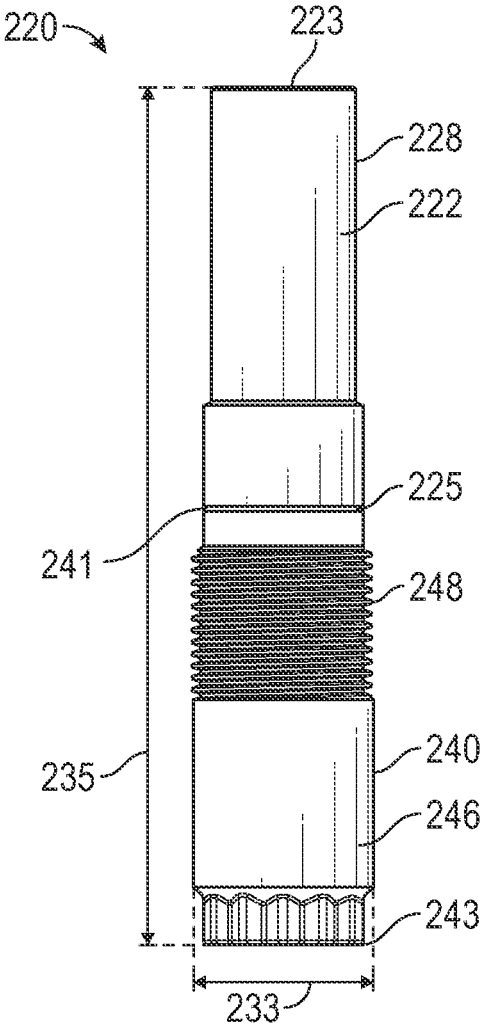
FIG. 7 is a side view of an embodiment of a nozzle assembly of the particle impact drill bit of FIG. 3.
Figure 8:
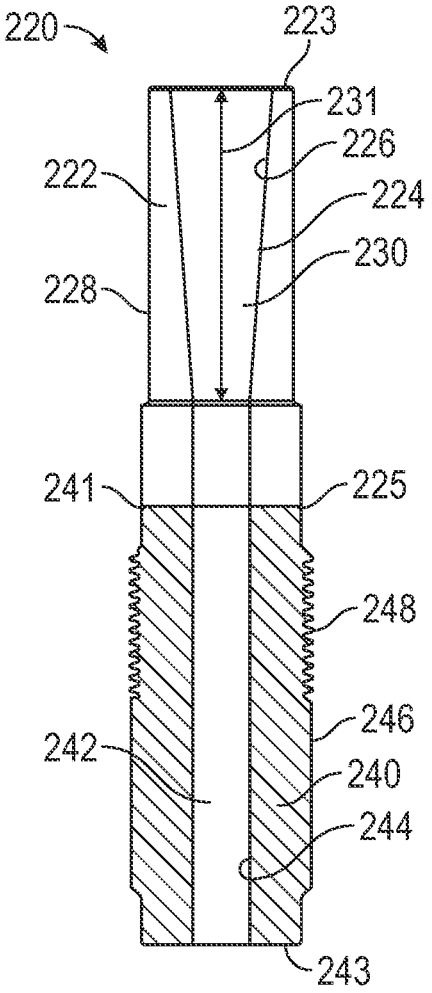
FIG. 8 is a side cross-sectional view of the nozzle assembly of FIG. 7.

Referring briefly to FIGS. 7, 8, each nozzle assembly 220 comprises a first or upstream sleeve 222 and a second or downstream sleeve 240. Particularly, upstream sleeve 222 includes a longitudinal first end 223, a longitudinal second end 225 opposite first end 223, a central bore or passage 224 defined by a generally cylindrical inner surface 226 extending between ends 223, 225, and a generally cylindrical outer surface 228 also extending between ends 223, 225. The central passage 224 of upstream sleeve 222 has a tapered section 230 having a longitudinally extending taper length 231. The fluid velocity of the drilling fluid 25 flowing through nozzle assembly 220 increases as it passes through the tapered section 230 due to the continuously decreasing diameter of tapered section 230.

The taper length 231 of tapered section 230 is maximized in this embodiment to concomitantly minimize the shear stress applied to the inner surface 226 of tapered section 230 by the drilling fluid 25 as it accelerates through the tapered section 230. The minimizing of shear stress applied to the inner surface 226 of tapered section by the drilling fluid 25 may minimize erosion of the tapered section 230 and thereby maximize the operational lifespan of the nozzle assembly 220. In this exemplary embodiment, the taper length 231 is greater than an overall or maximum width 233 of the nozzle assembly 220. The maximum width 233 of nozzle assembly 220 also being less than a maximum length 235 of the nozzle assembly 220. The taper length 231 may vary depending on the application, and particularly, on the initial velocity of the drilling fluid 25 as it enters nozzle assembly 220 so that a desired exit velocity of the drilling fluid 25 may be achieved.

The downstream sleeve 240 of nozzle assembly 220 includes a longitudinal first end 241, a longitudinal second end 243 opposite first end 241, a central bore or passage 242 defined by a generally cylindrical inner surface 244 extending between ends 241, 243, and a generally cylindrical outer surface 246 also extending between ends 241, 243. In this embodiment, a connector 248 is formed on the outer surface 246 of downstream sleeve 240. Connector 248 may releasably connect to a corresponding connector of one of the receptacles 216 of pilot section 210 to thereby releasably couple the downstream sleeve 240 with the body 207 of drill bit 200 such that nozzle assembly 220 is not ejected from the receptacle 216 by the flow of drilling fluid 25. In this exemplary embodiment, connector 248 comprises a threaded connector 248; however, it may be understood that the form of connector 248 may vary. The releasable connection formed between nozzle assembly 220 and the body 207 of drill bit 200 permits the nozzle assemblies 220 to be periodically replaced once the nozzle assembly has become worn without needing to also replace the body 207 of drill bit 200, minimizing the operational costs of drill bit 200. In some embodiments, the upstream sleeve 222 may simply be inserted into the receptacle 216 of body 207 following the coupling of the downstream sleeve 240 with the receptacle 216. While the upstream sleeve 222 may be free to move relative to the downstream sleeve 240 in this arrangement, the flow of drilling fluid 25 during operation presses the upstream sleeve 222 against the downstream sleeve 240, preventing upstream sleeve 222 from escaping the receptacle 216. In other embodiments, upstream sleeve 222 may be mechanically coupled to the downstream sleeve 240. As will be discussed further herein, one or both of the first end 223 of the upstream sleeve 222 and the second end 243 of downstream sleeve 240 may project outwardly from the receptacle 216 of body 207 in which the nozzle assembly 220 is received.

In addition to nozzle assembly 220 being configured to have a taper length 231 in excess of the maximum width 233 thereof, nozzle assembly 220 is also configured to have a relatively small maximum width 233 relative to the maximum length 235 of the nozzle assembly 220. In some embodiments, a ratio of the maximum length 235 of nozzle assembly 220 to the maximum width 233 of the nozzle assembly 220 may range approximately between 2:1 to 10:1; however, it may be understood that the ratio of the maximum length 235 to the maximum width 233 of nozzle assembly 220 may vary. Minimizing the maximum width 233 of nozzle assembly 220 allows for flexibility in positioning a plurality of nozzle assemblies 220 in the pilot section 210 at varying impingement angles to thereby desirably spread the energy of the jetted impactors 27 across the terminal end 17 of borehole 16. Additionally, the elongated nozzle assembly 220 minimizes changes in the direction of the flow of drilling fluid 25, in-turn minimizing the wear of nozzle assembly 220 during operation.

Given that nozzle assembly 220 is not integrally formed with body 207 of drill bit 200 it may be formed from materials which vary from those comprising body 207. In some embodiments, nozzle assembly 220 comprises a material having a greater hardness and/or resistance to wear than the material comprising body 207. For example, nozzle assembly 220 may comprise a solid carbide material. In other embodiments, nozzle assembly 220 may comprise a tungsten-carbide material. Additionally, the material comprising upstream sleeve 222 may vary from the material comprising downstream sleeve 240. For example, given that upstream sleeve 222 comprises the tapered section 230 which may result in increased shear stress being applied to upstream sleeve 222, upstream sleeve 222 may comprise a material having a greater hardness and/or resistance to wear than the material comprising downstream sleeve 240.

Figure 9:
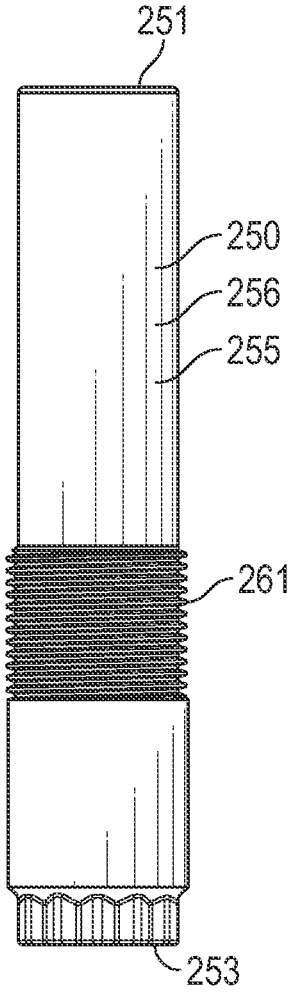
FIG. 9 is a side view of an embodiment of a nozzle.
Figure 10:
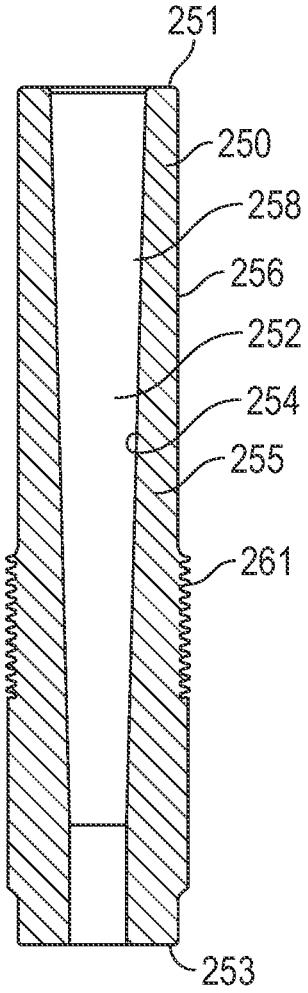
FIG. 10 is a side cross-sectional view of the nozzle of FIG. 9.
Figure 11:
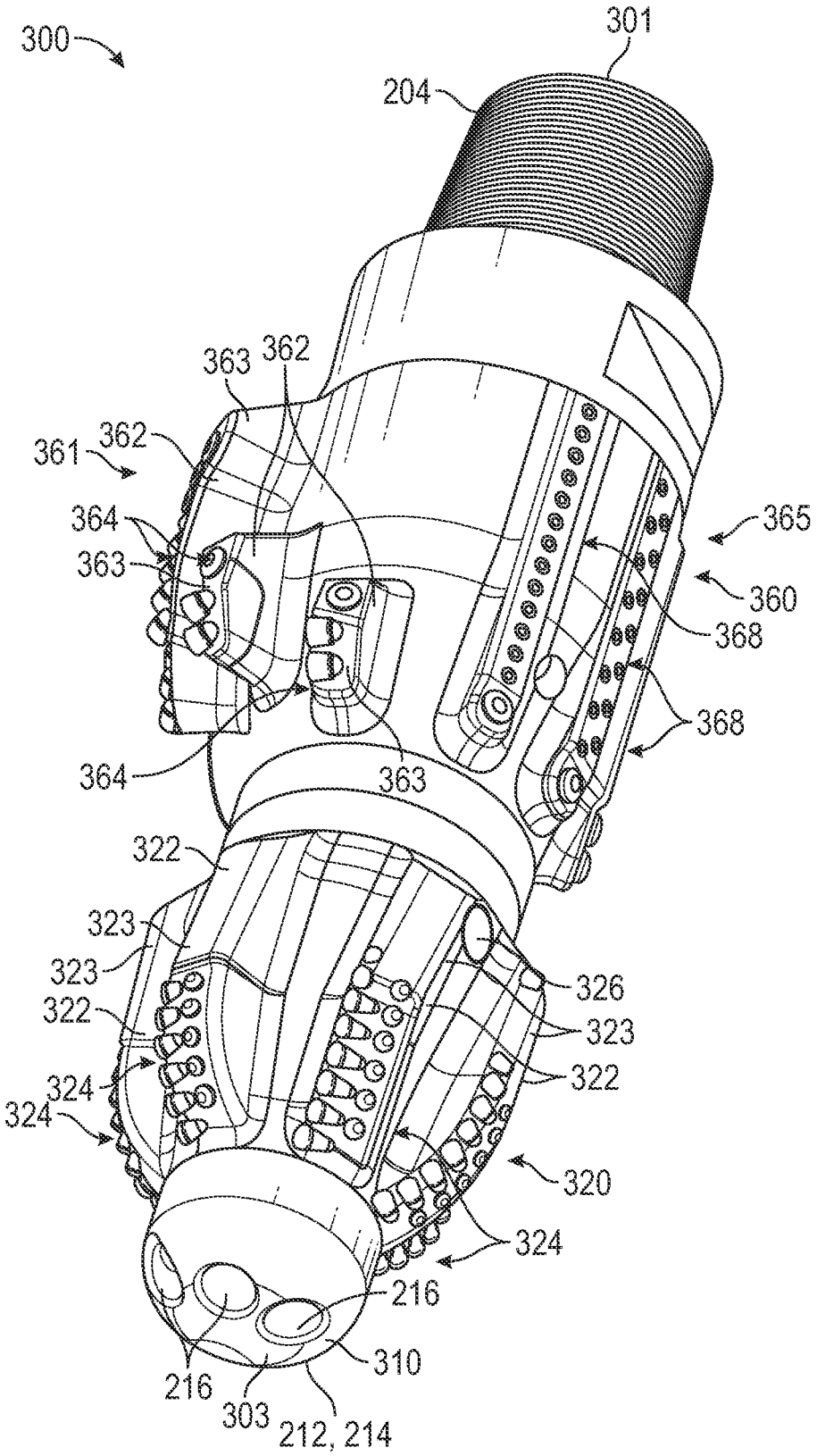
FIG. 11 is a perspective view of another embodiment of a particle impact drill bit.
Figure 12:
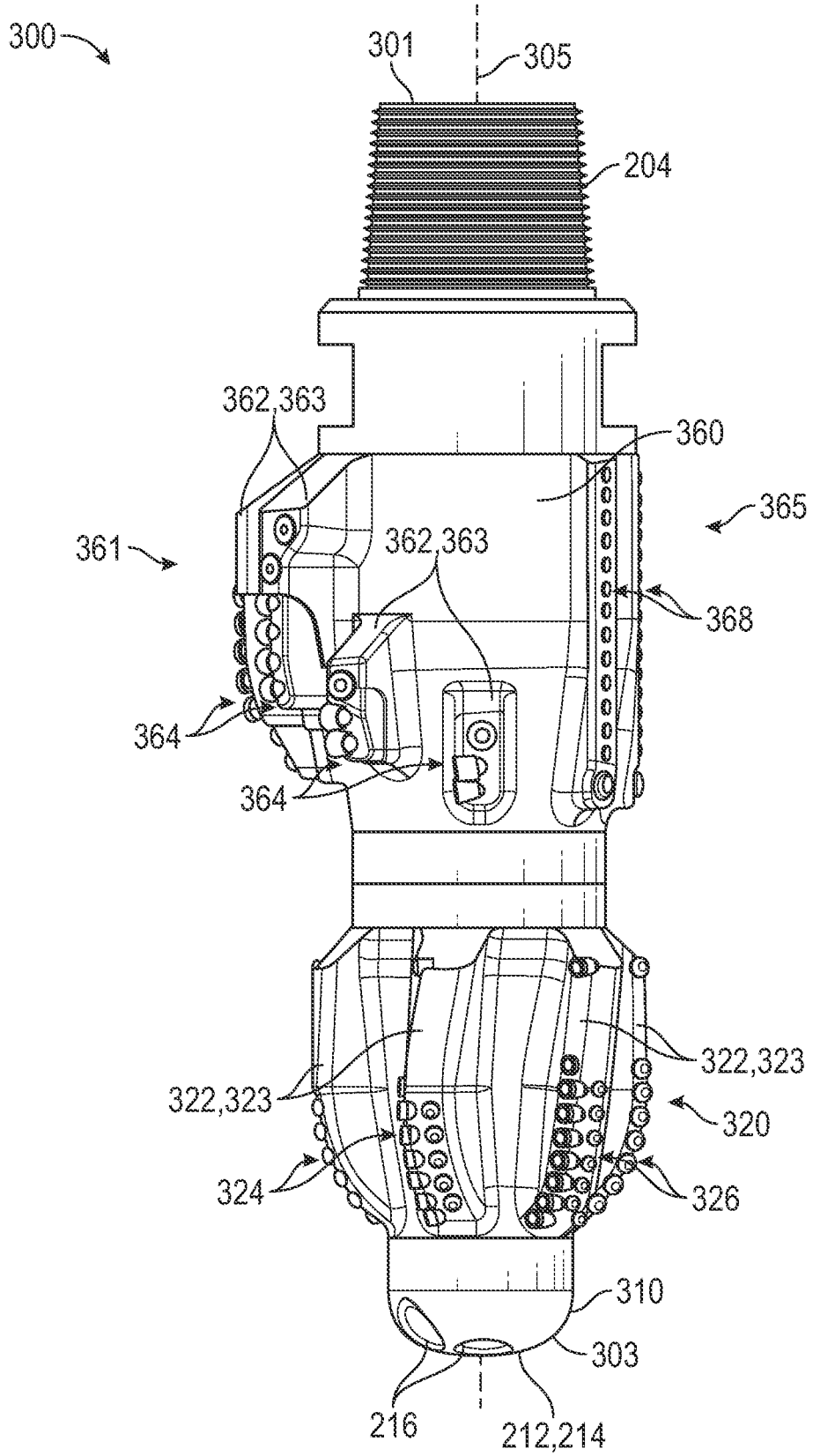
FIG. 12 is a side view of the particle impact drill bit of FIG. 11.
Figure 13:
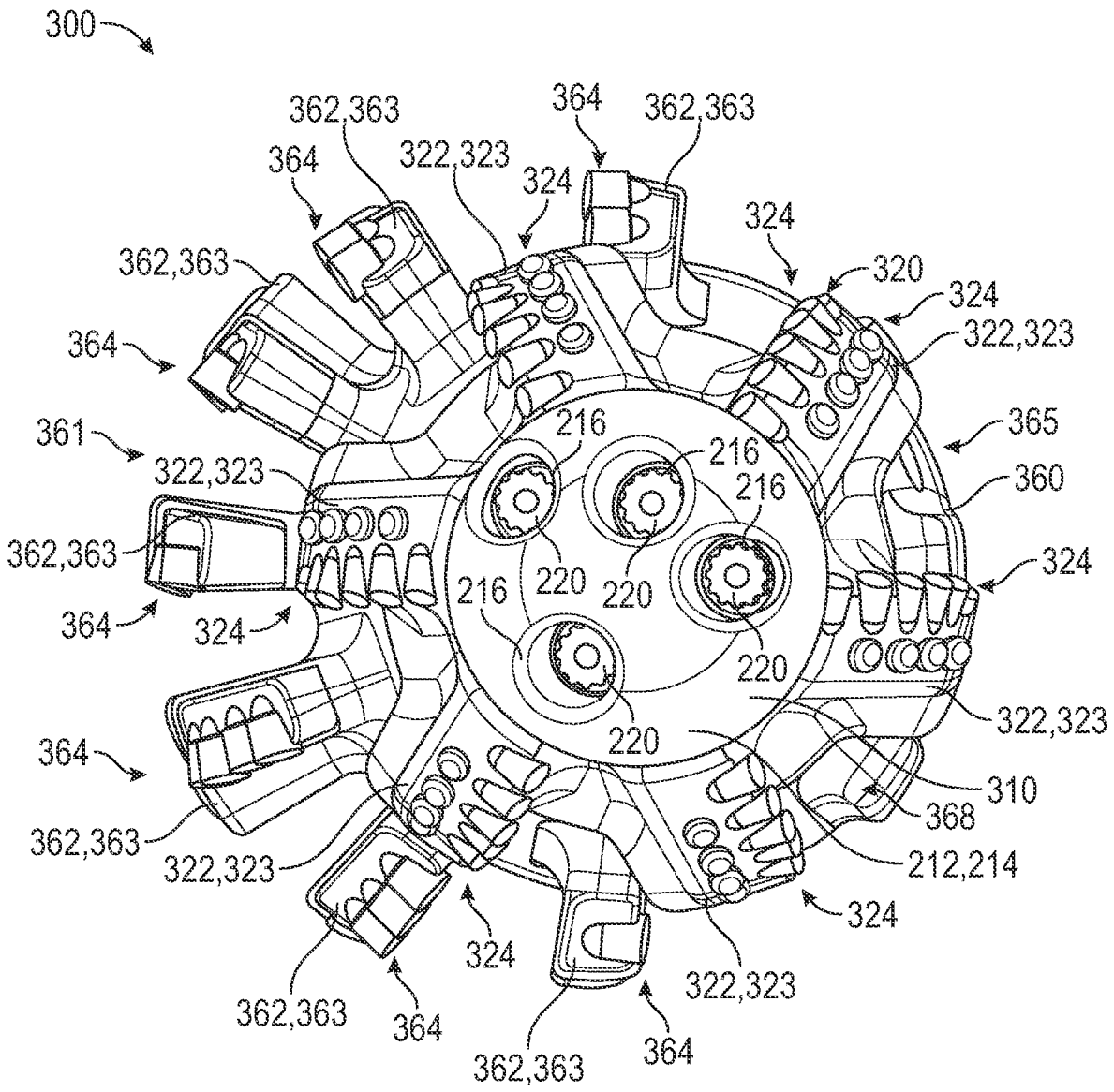
FIG. 13 is a bottom view of the particle impact drill bit of FIG. 11.
Figure 14:
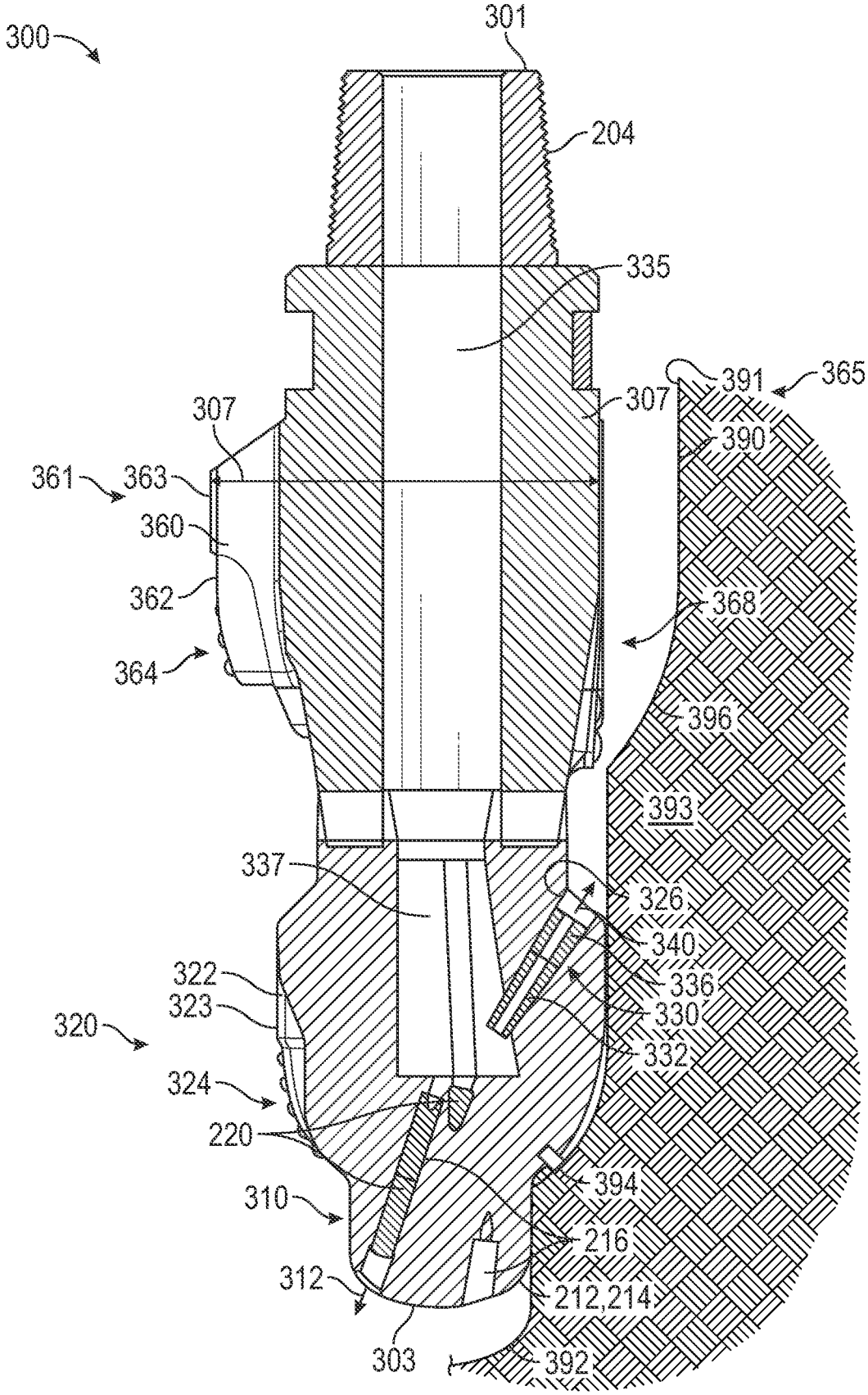
FIG. 14 is a side-cross sectional view of the particle impact drill bit of FIG. 11.
Figure 15:
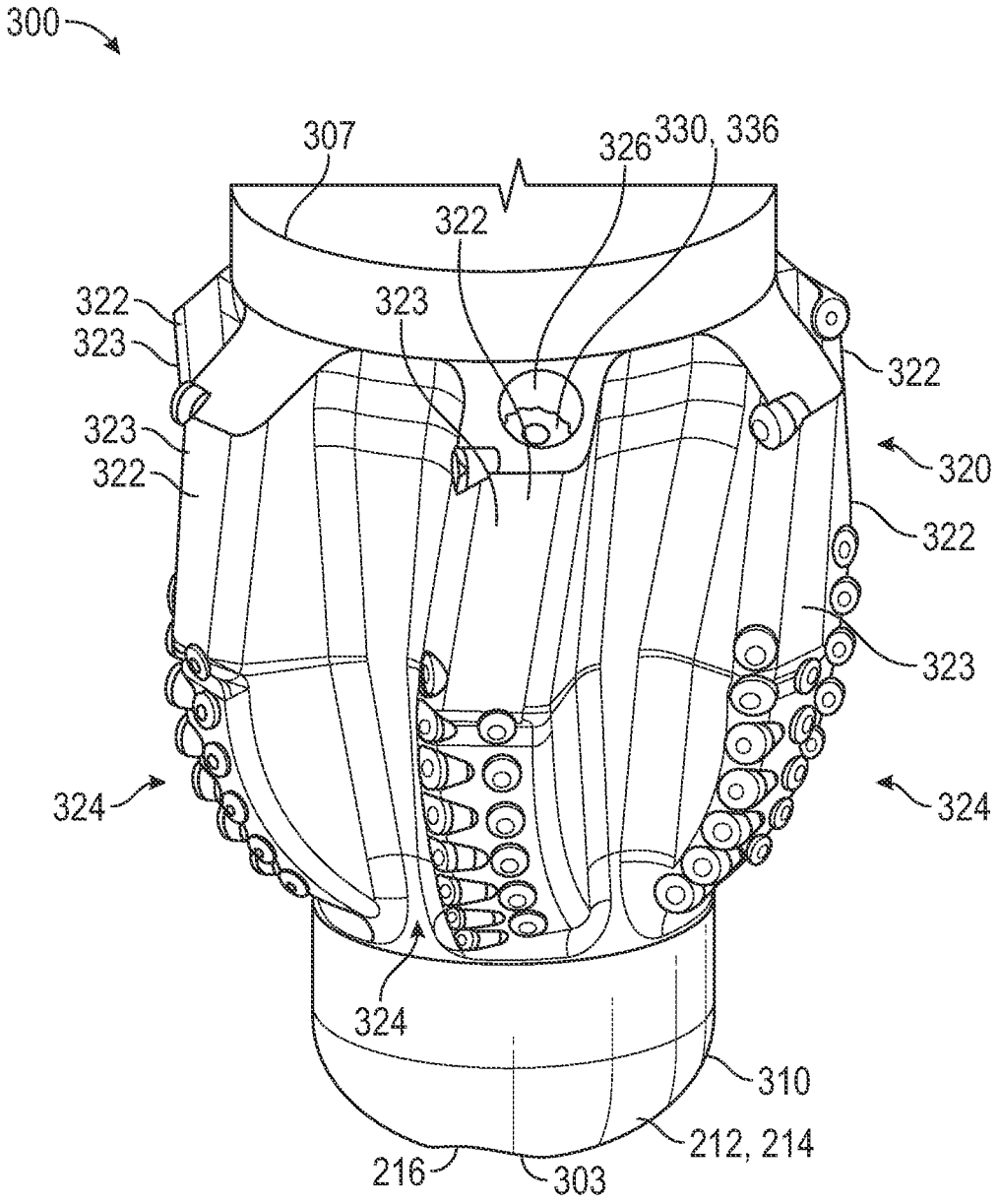
FIG. 15 is a partial perspective view of the particle impact drill bit of FIG. 11.

While in this exemplary embodiment nozzle assembly 220 comprises separate sleeves 222, 240 which assembled with the body 207 of drill bit 200, in other embodiments, nozzle assembly 220 may include a single sleeve. Thus, nozzle assembly 220 may also be referred to herein as nozzle 220. As an example, referring briefly to FIGS. 9, 10, another embodiment of a nozzle 250 is shown. Nozzle 250 includes a longitudinal first end 251, a longitudinal second end 253 opposite first end 251, a central bore or passage 252 defined by a generally cylindrical inner surface 254 extending between ends 251, 253, and a generally cylindrical outer surface 256 also extending between ends 251, 253. Additionally, nozzle 250 comprises a single, integrally or monolithically formed body 255 extending between ends 251, 253.

In this exemplary embodiment, the central passage 252 of nozzle 250 has a tapered section 258. Similar to nozzle assembly 220 described above, the tapered section 258 of nozzle 250 has a taper length which is greater than a maximum width of the nozzle 250. Additionally, the fluid velocity of the drilling fluid 25 flowing through nozzle 250 increases as it passes through the tapered section 258 due to the continuously decreasing diameter of tapered section 258. Further, a connector 261 is formed on the outer surface 256 of nozzle 250. Connector 261 may releasably connect to a corresponding connector of one of the receptacles 216 of pilot section 210 to thereby releasably couple the nozzle 250 with the body 207 of drill bit 200.

Referring again to FIGS. 3-6, the reamer section 260 of drill bit 200 includes a plurality of circumferentially spaced reamer blades 262 which extend radially outwards from the central axis 205 of drill bit 200. Similar to drill bit 100 shown in FIG. 2, each reamer blade 262 of reamer section 260 comprises a plurality of engagement or cutting members (indicated generally by arrows 264) positioned along an outer surface 263 of the reamer blade 262 and which are configured to mechanically engage or contact a sidewall 19 of the borehole 16. In this exemplary embodiment, cutting members 264 comprise PDC inserts distinct from body 207 of drill bit 200. However, in other embodiments, the configuration of cutting members 264 and reamer blades 262 may vary. Additionally, as with drill bit 100, the reamer blades 262 of reamer section 260 define a maximum width or diameter of the drill bit 200 which is greater than a maximum width or diameter of the pilot section 210 of drill bit 200.

Figure 5:
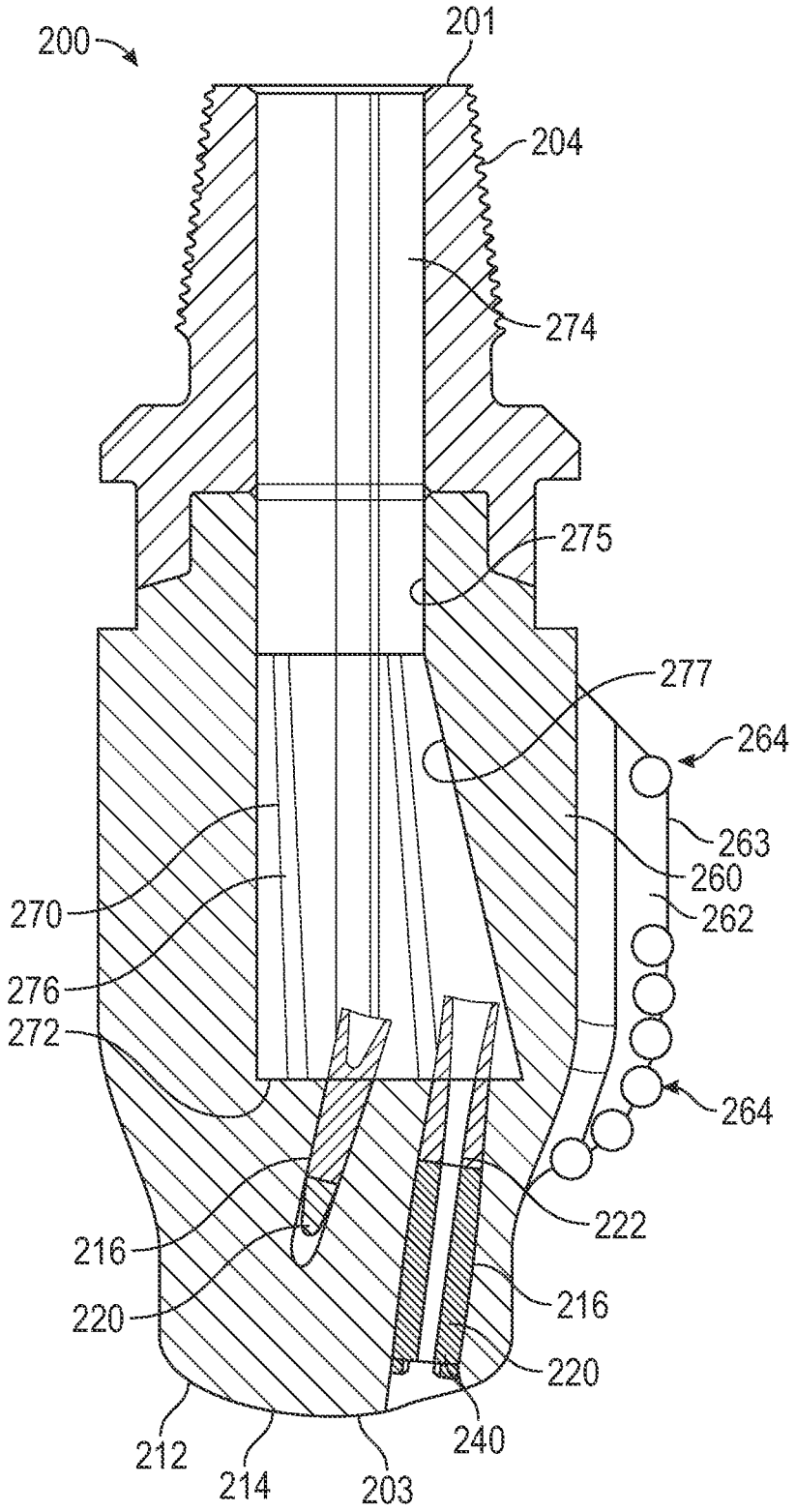
FIG. 5 is a side-cross sectional view of the particle impact drill bit of FIG. 3.
Figure 6:
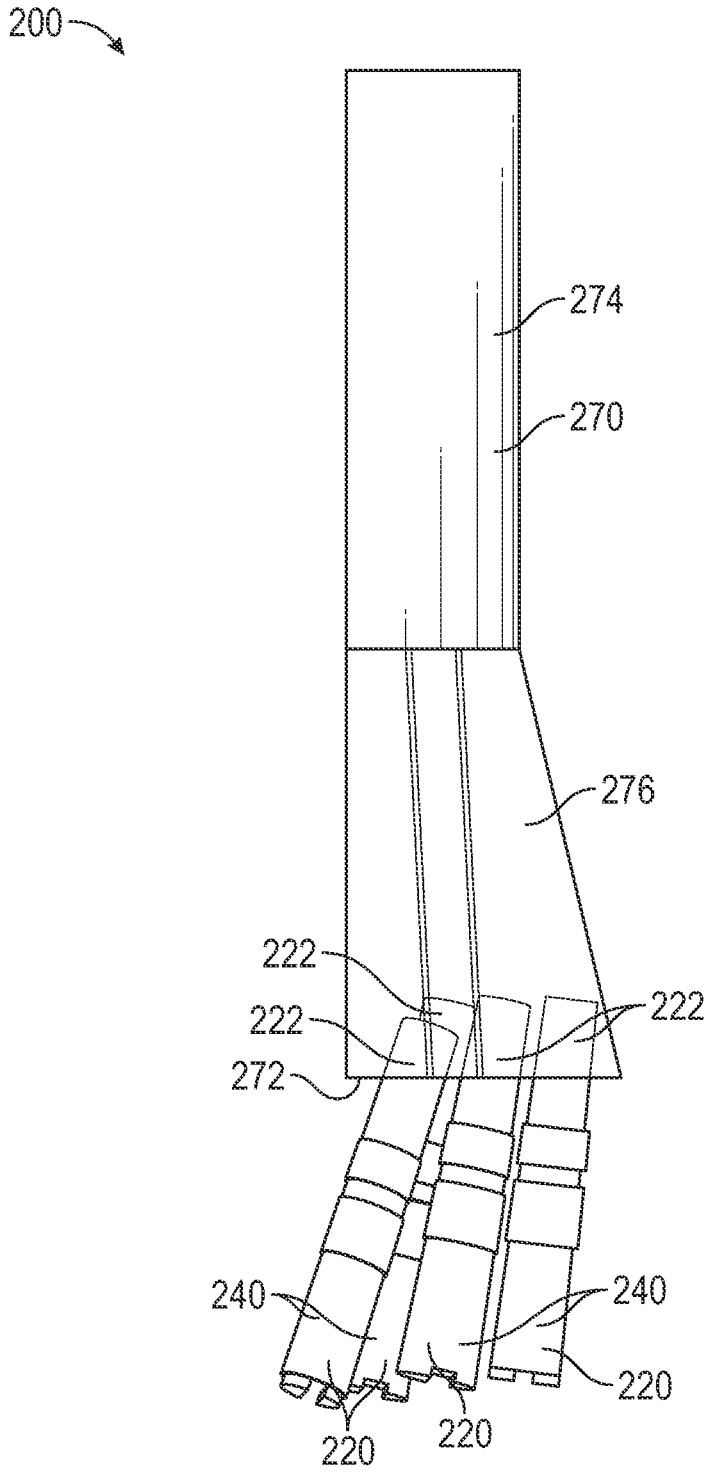
FIG. 6 is a side view of an embodiment of a fluid passage of the impact drill bit of FIG. 3.

As shown particularly in FIGS. 5, 6, drill bit 200 comprises a feed bore or passage 270 which extends into drill bit 200 from first end 201 to a terminal end 272 located within the body 207 of drill bit 200. Body 207 of drill bit 200 is hidden in FIG. 6 to conveniently illustrate the relationship between feed passage 270 and the nozzle assemblies 220 housed within the receptacles 216 of body 207. In this exemplary embodiment, feed passage 270 includes a cylindrical section or passage 274 extending from the first end 201 and an expansion passage or section 276 extending from the cylindrical passage 274 to the terminal end 272 of feed passage 270. Cylindrical passage 274 is defined by a cylindrical inner surface 275 while the expansion passage 276 is defined by a frustoconical inner surface 277. Additionally, a flow area of the cylindrical passage 274 remains relatively constant moving along the longitudinal length of cylindrical passage 274. Conversely, a flow area of expansion passage 276 increases moving towards the terminal end 272 of feed passage 270. Expansion passage 276 has an oval-shaped flow area in this exemplary embodiment; however, the shape of the flow area of expansion passage 276 may vary in other embodiments.

The gradual expansion of the flow area through expansion passage 276 approaching the terminal end 272 of feed passage 270 provides a smooth transition for the drilling fluid 25 as the drilling fluid 25 flows through feed passage 270 and into the nozzle assemblies 220 of pilot section 210. The smooth transition provided by expansion passage 276 in-turn minimizes disturbances to the flow of drilling fluid 25 such that a laminar flow of drilling fluid 25 is provided through feed passage 270. The laminar flow of drilling fluid 25 may minimize wear to the inner surfaces 275, 277 of feed passage 270 and thereby prolong the operational life of the body 207 of drill bit 200.

In this exemplary embodiment, each of the plurality of nozzle assemblies 220 projected through the terminal end 272 and into feed passage 270. Particularly, the upstream sleeve 222 of each nozzle assembly 220 projects into feed passage 270 rather than being recessed into the receptacle 216 in which the upstream sleeve 222 is received. In this configuration, any turbulence in the flow of drilling fluid 25 as the drilling fluid 25 reaches the terminal end 272 of feed passage 270 is focused onto the upstream sleeves 222 of nozzle assemblies 220 rather than onto the body 207 of drill bit 200.

As described above, nozzle assemblies 220, and particularly the upstream sleeves 222 thereof, may be formed of a material having a greater hardness and/or resistance to wear than the material comprising body 207. Thus, by focusing the turbulence and shear stresses associated therewith against the relatively durable nozzle assemblies 220, the overall wear subjected to drill bit 200 (including both body 207 and nozzle assemblies 220) may be minimized, increasing the operational life of drill bit 200. Additionally, the nozzle assemblies 220 may be conveniently replaced when worn.

Referring to FIGS. 11-15, another embodiment of a particle impact drill bit 300 is shown. Drill bit 300 may be utilized in well system 10 in lieu of the drill bit 100 shown in FIG. 2. Drill bit 300 has features in common with drill bit 200 shown in FIGS. 3-6, and shared features are labeled similarly. Drill bit 300 has a central or longitudinal axis 305, a longitudinal first end 301, and a longitudinal second end 303 opposite the first end 301. Drill bit 300 includes the connector 204 located at the second end 303 of drill bit 300 for connecting drill bit 300 with a bearing mandrel or other tubular member of a well system.

In this exemplary embodiment, drill bit 300 includes an integral or monolithic body 307 comprising a pilot section 310 located at the first end 301, a first or downhole reamer section 320 positioned between the pilot section 310 and the second end 303, and a second or uphole reamer section 360 positioned between downhole reamer section 320 and second end 303. Downhole reamer section 320 may also be referred to herein as lower reamer section 320 while uphole reamer section 360 may also be referred to herein as upper reamer section 360. In other embodiments, the pilot section 310, downhole reamer section 320, and/or uphole reamer section 360 may be formed from separate and distinct bodies which are later assembled or joined together to form drill bit 300. The pilot section 310 of drill bit 300 is similar in configuration as pilot section 210 of drill bit 200 and thus will not be discussed here in detail. Particularly, similar to pilot section 210 of drill bit 200, pilot section 310 comprises a plurality of the nozzle assemblies 220 each of which are configured to produce a first or lower jet (indicated by arrow 312 in FIG. 14) of drilling fluid 25 (including impactors 27) to distress a terminal end 392 of a borehole 390 formed in a subterranean earthen formation 393.

The downhole reamer section 320 of drill bit 300 includes a plurality of circumferentially spaced first or downhole reamer blades 322 which extend radially outwards from the central axis 305 of drill bit 300. Similar to drill bit 200 shown in FIGS. 3-6, each downhole reamer blade 322 of reamer section 320 comprises a plurality of engagement or cutting members (indicated generally by arrows 324) positioned along an outer surface 323 of the downhole reamer blade 322 and which are configured to mechanically engage or contact a sidewall 391 of a borehole 390 (shown schematically in FIG. 14) formed by drill bit 300. In this exemplary embodiment, cutting members 324 comprise PDC inserts distinct from body 307 of drill bit 300. However, in other embodiments, the configuration of cutting members 324 and downhole reamer blades 322 may vary. Additionally, in this exemplary embodiment, one or more of the downhole reamer blades 322 comprises a receptacle 326 extending at a non-zero, non-orthogonal angle relative to the central axis 305.

In this exemplary embodiment, in addition to downhole reamer blades 322, downhole reamer section 320 includes one or more circumferentially spaced nozzle assemblies 330 received in the receptacle 326 of a corresponding downhole reamer blade 322. Nozzle assemblies 330 are similar in configuration to nozzle assemblies 220 shown in FIGS. 5, 6 (in some embodiments nozzle assemblies 220 themselves may be received in receptacles 326 in lieu of nozzle assemblies 330) and comprise a tapered/converging first or upstream sleeve 332 and a second or downstream sleeve 336 which secures the nozzle assembly 330 into the given receptacle 326 via a connector 338 formed on an outer surface thereof. Additionally, as with nozzle assemblies 220 of pilot section 310, nozzle assemblies 330 project or extend into a central feed passage 335 of drill bit 300 which is in fluid communication with both nozzle assemblies 330 of downhole reamer section 320 and the nozzle assemblies 220 of pilot section 310. Similar to feed passage 270 of drill bit 200, feed passage 335 of drill bit 300 includes an expansion passage or section 337 with a gradually expanding flow area moving in a downstream direction.

In this exemplary embodiment, nozzle assembly 330 accelerates the velocity of drilling fluid 25 as the drilling fluid 25 flows therethrough whereby a second or upper jet (indicated by arrow 340 in FIG. 14) is directed against the sidewall 391 of the borehole 390. Thus, instead of being directed against the terminal end 392 of borehole 390 as with lower jets 312 produced by pilot section 310, upper jets 340 produced by downhole reamer section 320 are directed against the sidewall 391 of borehole 390. Particularly, upper jets 340 are directed against and contact the portion of sidewall 391 extending uphole from an annular first or downhole shoulder 394 formed by downhole reamer section 320 as drill bit 300 penetrates into earthen formation 393. Thus, upper jets 340 fracture and/or distress the portion of sidewall 391 that has already been expanded by downhole reamer section 320. To state in other words, as drill bit 300 penetrates into earthen formation 393, initially the terminal end 392 of borehole 390 is fractured and/or distressed by lower jets 312 of pilot section 310. The initial hole formed by pilot section 310 is then stabilized and expanded by downhole reamer section 320. The portion of the newly created section of borehole 390 is then fractured and/or distressed by upper jets 340.

To fracture and/or distress the portion of borehole 390 expanded by downhole reamer section 320, the jets 340 produced by downhole reamer section 320 (as well as the nozzle assemblies 330 which produce upper jets 340) are oriented in an uphole direction facing away from the terminal end 392 of borehole 390, in contrast to the lower jets 312 (along with the nozzle assemblies 220 which produce lower jets 312) which are oriented in a downhole direction facing the terminal end 392 of borehole 390. To state in other words, in this exemplary embodiment, upper jets 340/nozzle assemblies 330 of downhole reamer section 320 are oriented at an obtuse angle relative to lower jets 312/nozzle assemblies 220 of pilot section 310.

The uphole reamer section 360 of drill bit 300 includes a plurality of circumferentially spaced second or uphole reamer blades 362 which extend radially outwards from the central axis 305 of drill bit 300. In this exemplary embodiment, a longitudinal length (e.g., a length extending substantially parallel central axis 305) of at least some of the uphole reamer blades 362 may vary. Uphole reamer blades 362 are axially spaced from the lower downhole reamer blades 322 of lower reamer section 320. Similar to drill bit 200 shown in FIGS. 3-6, each uphole reamer blade 362 of reamer section 360 comprises a plurality of engagement or cutting members (indicated generally by arrows 364) positioned along an outer surface 363 of the uphole reamer blade 362 and which are configured to mechanically engage or contact a sidewall 391 of a borehole 390 (shown schematically in FIG. 14) formed by drill bit 300. In this exemplary embodiment, cutting members 364 comprise PDC inserts distinct from body 307 of drill bit 300. However, in other embodiments, the configuration of cutting members 364 and uphole reamer blades 362 may vary.

In this exemplary embodiment, the uphole reamer blades 362 of uphole reamer section 360 define a maximum width or diameter 309 of the drill bit 300 which is greater than both a maximum width or diameter of pilot section 310 and a maximum width or diameter of downhole reamer section 320. Thus, as drill bit 300 penetrates further into earthen formation 393, the relatively larger reamer blades 364 of uphole reamer section 360 mechanically cut into the portion of sidewall 391 fractured and/or distressed by upper jets 340 to expand the diameter of borehole 390 and thereby form an annular second or uphole shoulder 396 that is axially spaced from the downhole shoulder 394 formed by downhole reamer section 320.

In this exemplary embodiment, uphole reamer blades 362 are not positioned entirely about the central axis 305 of drill bit 300 and instead are located only along a single half of the circumference of uphole reamer section 360. To state in other words, in this exemplary embodiment, uphole reamer blades 362 are positioned only along a first lateral side (indicated by arrow 361 in FIG. 13) of uphole reamer section 360 while an opposing second lateral side (indicated by arrow 365 in FIG. 13) of uphole reamer section does not include any uphole reamer blades 362. In this exemplary embodiment, each lateral side 361, 365 of uphole reamer section 360 extends substantially and contiguously 180° about the central axis 305 of drill bit 300; however, in other embodiments, the circumferential length of lateral sides 361, 365 may vary. For example, in other embodiments, first lateral side 361 may extend only 90° about the central axis 305 while second lateral side 365 extends 270° about central axis 305. In this exemplary embodiment, uphole reamer section 360 comprises a plurality of wear members or buttons (indicated generally by arrow 368) which are positioned along the second lateral side 365. Wear buttons 368 comprise a hardened, wear resistant material which stabilize drill bit 300 and protect the body 307 of drill bit 300 from wear when the drill bit 300 is lowered from the surface and through the borehole 390 towards the terminal end 392 thereof.

By positioning uphole reamer blades 362 only along one lateral side 361 of uphole reamer section 360, drill bit 300 forms or comprises a "bi-center" drill bit 300 in which the maximum width or diameter of drill bit 300 varies depending upon whether drill bit 300 is in rotation about central axis 305. Particularly, drill bit 300 comprises a first maximum outer diameter 309 when drill bit 300 does not rotate about central axis 305 and a second maximum diameter 309 when drill bit 300 rotated about central axis 305 that is larger than the first maximum outer diameter 309, where the difference between the first and second maximum diameters 309 is dependent on the radially extending (relative central axis 305) size of uphole reamer blades 362.

As an example, when drill bit 300 is run-in or lowered from the surface through borehole 390 (e.g., following the casing of an already drilled section of borehole 390, etc.), drill bit 300 may be slid through borehole 390 such that drill bit 300 is held relatively stationary about central axis 305 to thereby minimize the maximum outer diameter 309 of drill bit 300. Once drill bit 300 reaches a drilling position in borehole 390 proximal terminal end 392 to resume drilling of borehole 390, drill bit 300 may be rotated about central axis 305 (e.g., from the surface or via a downhole mud motor) as drilling fluid 25 is pumped through drill bit 300 causing drill bit 300 to drill into the terminal end 392 of borehole 390 and thereby extend borehole 390.

As drill bit 300 rotates about central axis 305, uphole reamer blades 362 mechanically cut into the sidewall 391 of borehole 390 thereby expanding a diameter of the borehole 390 to a size corresponding or equivalent to the second and larger maximum outer diameter 309 of drill bit 300. By minimizing the maximum outer diameter 309 of drill bit 300 as drill bit 300 is run-into the borehole 390, the taper or reduction in diameter of borehole 390 that occurs moving from the surface towards terminal end 392 may be minimized given that at the reduced first maximum outer diameter 309 the drill bit 300 can successfully fit through each section of the borehole 390 as it travels towards the drilling position proximal terminal end 392. In at least some applications, it may be advantageous to minimize or eliminate (e.g., the borehole 390 may have a constant inner diameter along its longitudinal length) the taper of borehole 390 along its longitudinal length to thereby, for example, maximize the flow area within the most downhole portion of borehole 390 proximal terminal end 392.

Figure 16:
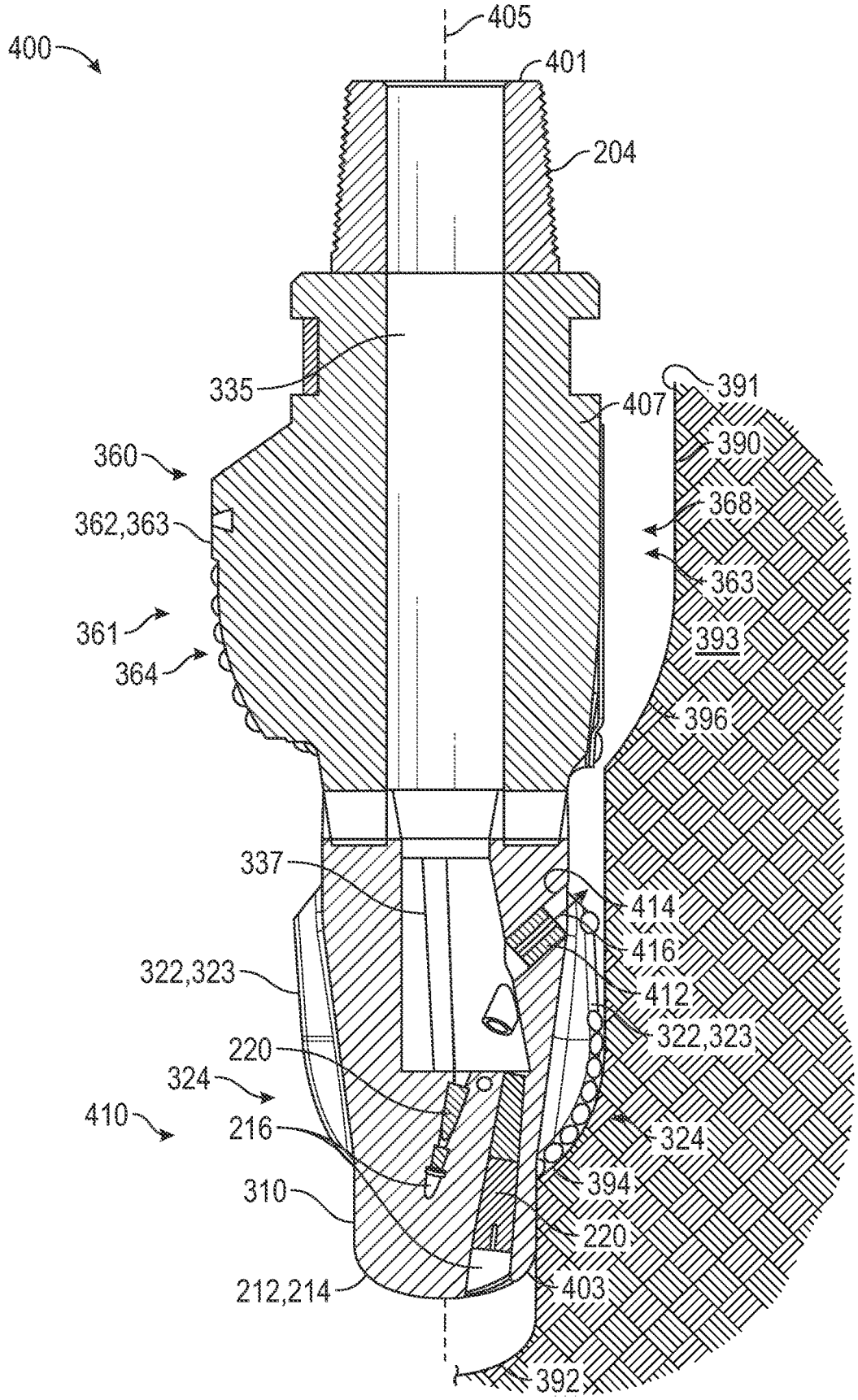
FIG. 16 is a side cross-sectional view of another embodiment of a particle impact drill bit.
Figure 17:
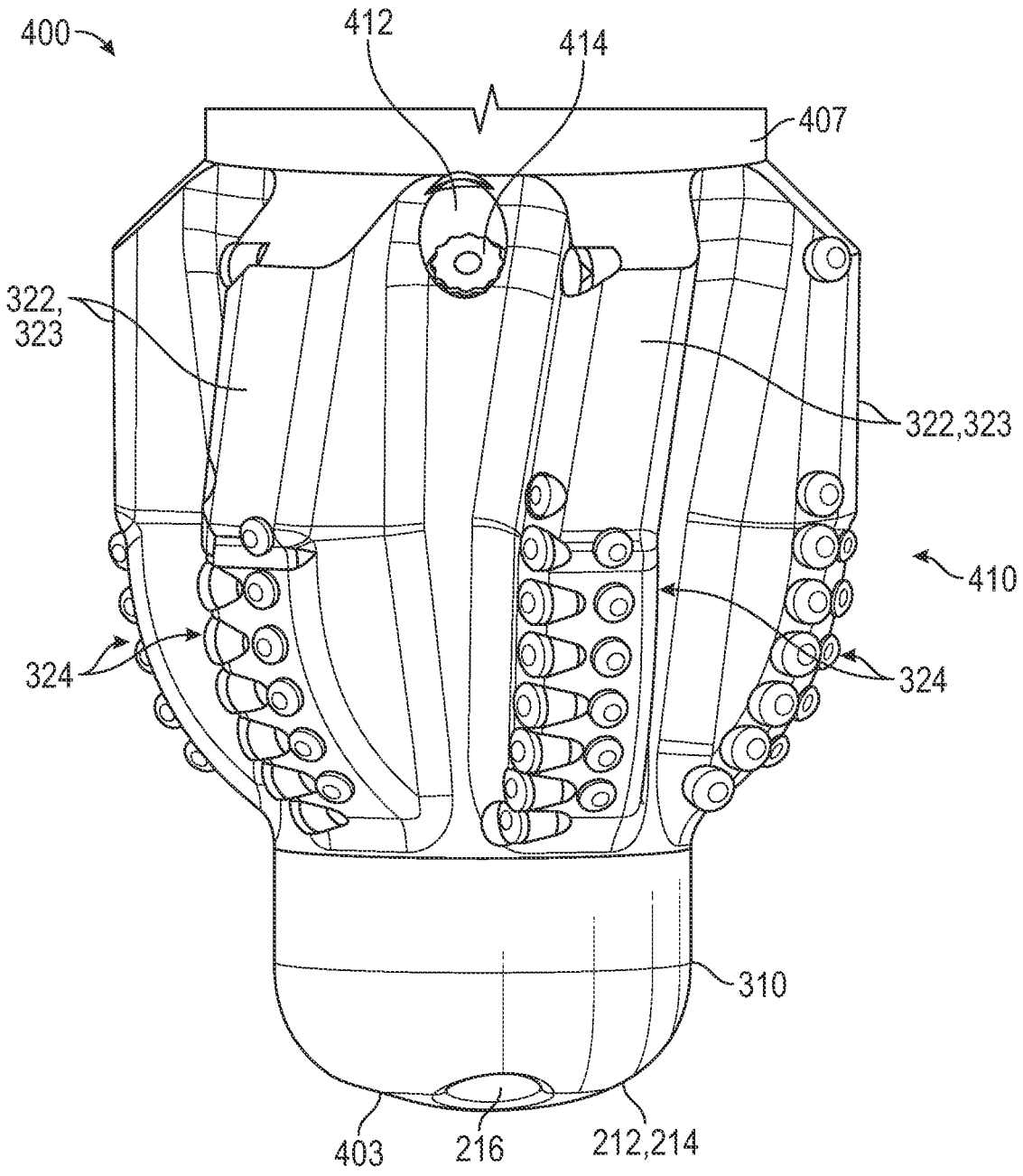
FIG. 17 is a partial perspective view of the particle impact drill bit of FIG. 16.

Referring to FIGS. 16, 17, another embodiment of a particle impact drill bit 400 is shown. Drill bit 400 may be utilized in well system 10 in lieu of the drill bit 100 shown in FIG. 2. Additionally, drill bit 400 has features in common with drill bit 300 shown in FIGS. 11-15, and shared features are labeled similarly. Drill bit 400 has a central or longitudinal axis 405, a longitudinal first end 401, and a longitudinal second end 403 opposite the first end 401. Additionally, drill bit 400 includes an integral or monolithic body 407 comprising pilot section 310 located at the first end 401, a first or downhole reamer section 410 positioned between the pilot section 310 and the second end 403, and uphole reamer section 360 positioned between downhole reamer section 410 and second end 403. Downhole reamer section 410 may also be referred to herein as lower reamer section 410. In other embodiments, the pilot section 310, downhole reamer section 410, and/or uphole reamer section 360 may be formed from separate and distinct bodies which are later assembled or joined together to form drill bit 400.

Downhole reamer section 410 of drill bit 400 includes the plurality of circumferentially spaced downhole reamer blades 322. Additionally, in this exemplary embodiment, downhole reamer section 410 includes one or more circumferentially spaced receptacles 412 extending at a non-zero, non-orthogonal angle relative to the central axis 405. Unlike downhole reamer section 320 of drill bit 300, the one or more receptacles 412 are positioned circumferentially between reamer blades 322. The one or more receptacles 412 receive a corresponding nozzle 414 secured therein and configured to produce a second or upper jet (indicated by arrow 416 in FIG. 16) of drilling fluid 25 (containing impactors 27) directed against the sidewall 391 of borehole 390. Nozzle 414 is axially spaced from the plurality of nozzle assemblies 220 of pilot section 310. Jet 416 and nozzle 414 are each oriented in an uphole direction that is in an obtuse angle relative to the direction of jets 312 produced by the pilot section 310 of drill bit 400. Additionally, in this exemplary embodiment, nozzles 414 comprise a singular, tapered or converging nozzle rather than an assembly. Additionally, each nozzle 414 comprises a connector which couples to a connector formed on an inner surface of the corresponding receptacle 412.

Figure 18:
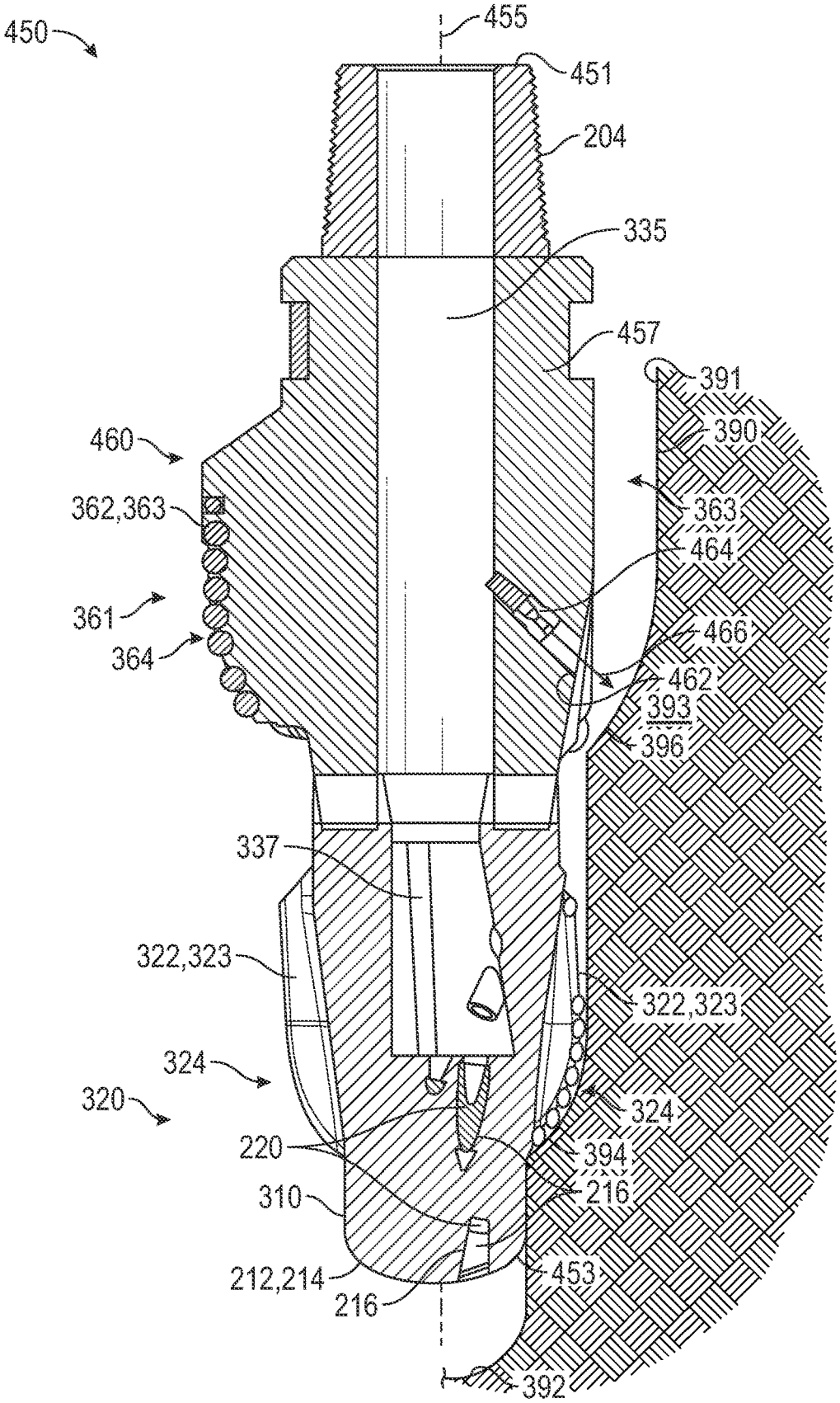
FIG. 18 is a side cross-sectional view of another embodiment of a particle impact drill bit.
Figure 19:
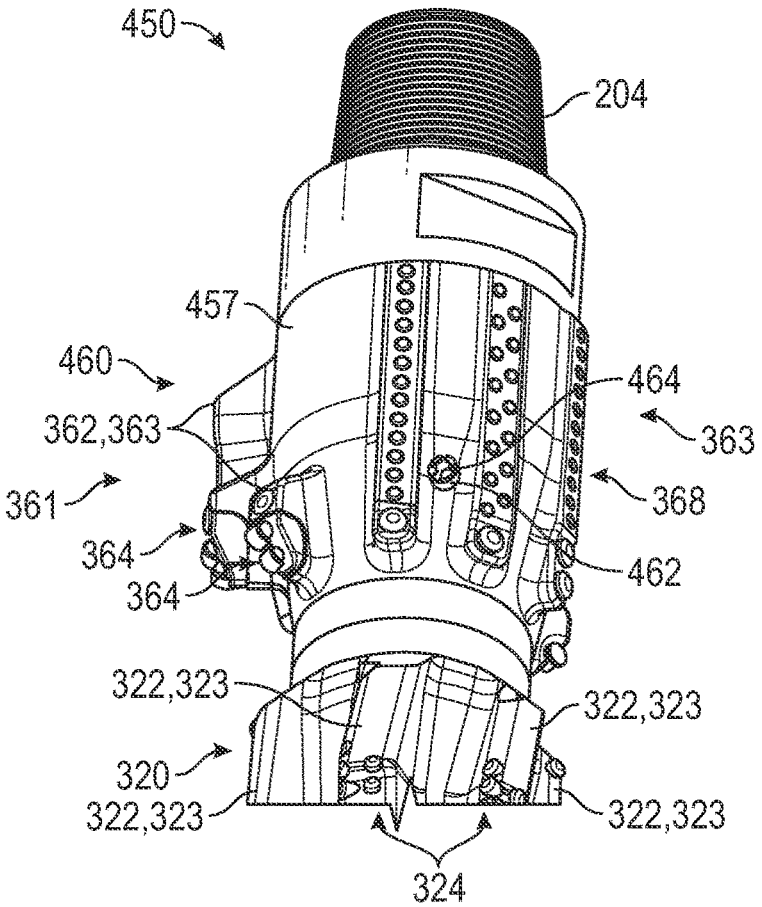
FIG. 19 is a partial perspective view of the particle impact drill bit of FIG. 18.

Referring to FIGS. 18, 19, another embodiment of a particle impact drill bit 450 is shown. Drill bit 450 may be utilized in well system 10 in lieu of the drill bit 100 shown in FIG. 2. Additionally, drill bit 450 has features in common with drill bit 300 shown in FIGS. 11-15, and shared features are labeled similarly. Drill bit 450 has a central or longitudinal axis 455, a longitudinal first end 451, and a longitudinal second end 453 opposite the first end 451. Additionally, drill bit 450 includes an integral or monolithic body 457 comprising pilot section 310 located at the first end 451, a downhole reamer section 320 positioned between the pilot section 310 and the second end 453, and a second or uphole reamer section 460 positioned between downhole reamer section 320 and second end 453. Uphole reamer section 460 may also be referred to herein as upper reamer section 460. In other embodiments, the pilot section 310, downhole reamer section 320, and/or uphole reamer section 460 may be formed from separate and distinct bodies which are later assembled or joined together to form drill bit 450.

Uphole reamer section 460 includes the plurality of reamer blades 362 positioned along the first lateral side 361 thereof. In this exemplary embodiment, uphole reamer section 460 additionally includes one or more receptacles 462 and one or more tapered/converging nozzles 464 configured to produce a second or upper jet (indicated by arrow 466 in FIG. 18) of drilling fluid 25 (containing impactors 27) directed against the sidewall 391 of borehole 390. Nozzle 464 is axially spaced from the nozzle assemblies 220 of pilot section 310. Additionally, jet 466 and nozzle 464 are each oriented in a downhole direction that is parallel with, or at an acute angle from, the jets 312 produced by pilot section 310. In this configuration, jets 466 concurrently fracture and/or distress the portion of sidewall 391 mechanically engaged by the reamer blades 362 of uphole reamer section 360.

While in this exemplary embodiment drill bit 450 includes both nozzle assemblies 330 of downhole reamer section 320 and the nozzles 464 of uphole reamer section 460, in other embodiments, drill bit 450 may only include nozzles 464 (or another nozzle or nozzle assembly) and thus may exclude nozzle assemblies 330. In such an embodiment, only pilot section 310 and uphole reamer section 460 would include nozzles/nozzle assemblies for fracturing and/or distressing portions of the borehole 390 engaged by drill bit 450.

Figure 20:
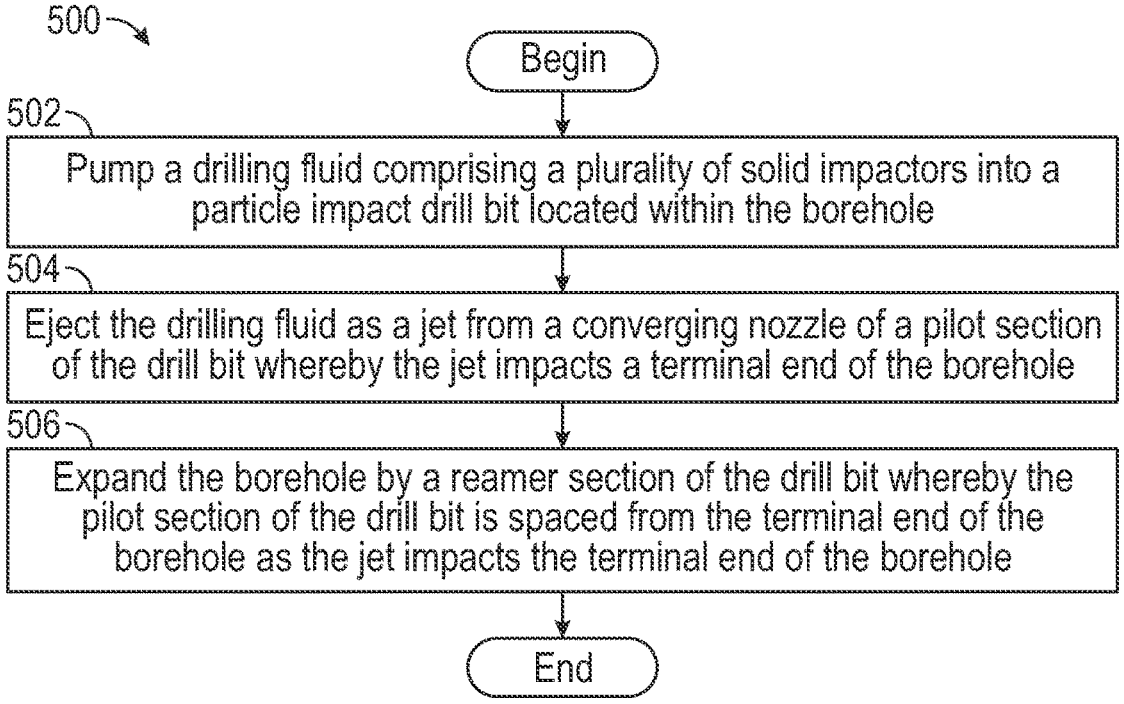
FIG. 20 is a flowchart of an embodiment of a method for forming a borehole extending through a subterranean earthen formation is shown.

Referring to FIG. 20, an embodiment of a method 500 for forming a borehole extending through a subterranean earthen formation is shown. Beginning at block 502, method 500 includes pumping a drilling fluid comprising a plurality of solid impactors into a particle impact drill bit located within the borehole. In some embodiments, block 502 comprises pumping the drilling fluid 25 of the well system 10 shown in FIG. 1 to the drill bit 100 shown in FIGS. 1, 2. In certain embodiments, block 502 comprises pumping drilling fluid comprising a plurality of solid impactors (e.g., impactors 27 shown in FIG. 1) to one of the drill bits 200, 300, 400, and 450 shown in FIGS. 3-19.

At block 504, method 500 comprises ejecting the drilling fluid as a jet from a converging nozzle of a pilot section of the drill bit whereby the jet impacts a terminal end of the borehole. In some embodiments, block 504 comprises ejecting the drilling fluid 25 as jets 90 from the nozzles 106 of the pilot section 102 of drill bit 100 shown in FIG. 2 whereby the jets 90 impact the terminal end 17 of the borehole 16. In certain embodiments, block 504 comprises ejecting a drilling fluid comprising a plurality of solid impactors as jets from the nozzle assemblies 220 of the pilot section 210 of drill bit 200 shown in FIGS. 3-6 whereby the jets impact the terminal end of a borehole. In certain embodiments, block 504 comprises ejecting a drilling fluid comprising a plurality of solid impactors as jets from the nozzle assemblies 220 of the pilot section 310 of drill bits 300, 450, or from the nozzle assemblies 220 of pilot section 310 of drill bit 400.

At block 506, method 500 comprises expanding the borehole by a reamer section of the drill bit whereby the pilot section of the drill bit is spaced from the terminal end of the borehole as the jet impacts the terminal end of the borehole. In some embodiments, block 506 comprises expanding the borehole 16 shown in FIGS. 1, 2 by the reamer section 120 shown in FIG. 2 of the drill bit 100 whereby the pilot section 102 of the drill bit 100 is spaced by the longitudinal distance 37 from the terminal end 17 of the borehole 16 as the jets 90 impact the terminal end 17. In certain embodiments, block 506 comprises expanding the borehole by the reamer section 260 of the drill bit 200 shown in FIGS. 3-6 whereby the pilot section 210 of the drill bit 200 is spaced from the terminal end of the borehole as the jets ejected from the pilot section 210 impact the terminal end of the borehole. In some embodiments, block 506 comprises expanding the borehole by both reamer sections 320, 360 of drill bit 300, the reamer sections 410, 360 of drill bit 400, and the reamer sections 320, 460 of drill bit 450.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A particle impact drill bit for a well system, the drill bit comprising:

a central axis, a longitudinal first end, a longitudinal second end opposite the first end, and a feed passage extending into the drill bit from the second end to receive a drilling fluid comprising a plurality of solid impactors;

a pilot section located centrally along the central axis at the first end, the pilot section comprising one or more converging nozzles in fluid communication with the feed passage configured to emit a jet of the drilling fluid comprising the plurality of solid impactors to fluidically fracture the earthen formation; and a reamer section located centrally along the central axis between the first end and the second end and coupled to the pilot section whereby relative axial movement between the reamer section and the pilot section is restricted, and wherein the reamer section comprises one or more reamer blades extending radially outwards from the central axis of the drill bit, and wherein the reamer section defines a maximum width of the drill bit.

2. The drill bit of claim 1, wherein the drill bit comprises a monolithically formed body which includes both the pilot section and the reamer section.

3. The drill bit of claim 1, further comprising a connector located at the second end of the drill bit.

4. The drill bit of claim 1, wherein at least one of the converging nozzles has a maximum length that is greater than a maximum width of the converging nozzle.

5. The drill bit of claim 1, wherein at least one of the converging nozzles has a tapered central passage comprising a taper length which is greater than a maximum width of the converging nozzle.

6. The drill bit of claim 1, wherein the pilot section comprises a first body formed from a first material and the reamer section comprises a second body formed from a second material, and wherein the first material has a greater hardness than the second material.

7. The drill bit of claim 1, wherein the reamer section comprises a first reamer section and the one or more reamer blades comprises one or more first reamer blades, and wherein the drill bit further comprises a second reamer section located between the first reamer section and the second end and comprising one or more second reamer blades extending radially outwards from the central axis of the drill bit.

8. The drill bit of claim 7, wherein the one or more converging nozzles of the pilot section comprise one or more first converging nozzles and the second reamer section comprises one or more second converging nozzles in fluid communication with the feed passage and axially spaced from the one or more first converging nozzles.

9. The drill bit of claim 8, wherein at least one of the one or more first converging nozzles is oriented at an obtuse angle relative to at least one of the one or more second converging nozzles.

10. The drill bit of claim 7, wherein the drill bit comprises a first lateral side and a second lateral side opposite the first lateral side, and wherein the one or more reamer blades of the reamer section are positioned only on the first lateral side of the drill bit.

11. The drill bit of claim 1, wherein the one or more converging nozzles of the pilot section comprise one or more first converging nozzles and the reamer section comprises one or more second converging nozzles in fluid communication with the feed passage and axially spaced from the one or more first converging nozzles.

12. The drill bit of claim 11, wherein the reamer section comprises a first reamer section and the one or more reamer blades comprises one or more first reamer blades, and wherein the drill bit further comprises a second reamer section located between the first reamer section and the second end and comprising one or more second reamer blades extending radially outwards from the central axis of the drill bit.

13. A well system, the system comprising:

a drilling rig;

a drill string extending from the drilling rig into a borehole extending through a subterranean earthen formation;

a surface pump configured to pump a drilling fluid through the drill string, wherein the drilling fluid comprises a plurality of solid impactors; and a particle impact drill bit coupled to an end of the drill string, wherein the drill bit comprises a pilot section located centrally along a central axis of the drill bit and comprising one or more converging nozzles each configured to emit a jet of the drilling fluid comprising the plurality of solid impactors to fluidically fracture the earthen formation, and a reamer section located centrally along the central axis and coupled to the pilot section whereby relative axial movement between the reamer section and the pilot section is restricted, and wherein the reamer section comprises one or more reamer blades extending radially outwards from the central axis of the drill bit.

14. The system of claim 13, wherein the pilot section of the drill bit comprises a first body formed from a first material and the reamer section comprises a second body formed from a second material, and wherein the first material has a greater hardness than the second material.

15. The system of claim 13, wherein at least one of the converging nozzles of the drill bit has a tapered central passage comprising a taper length which is greater than a maximum width of the converging nozzle.

16. The system of claim 13, wherein the reamer section of the drill bit comprises a first reamer section and the one or more reamer blades comprises one or more first reamer blades, and wherein the drill bit further comprises a second reamer section located between the first reamer section and an uphole end of the drill bit and comprising one or more second reamer blades extending radially outwards from the central axis of the drill bit.

17. The system of claim 16, wherein the one or more converging nozzles of the pilot section of the drill bit comprise one or more first converging nozzles and the second reamer section comprises one or more second converging nozzles axially spaced from the one or more first converging nozzles.

18. The system of claim 13, wherein the one or more converging nozzles of the pilot section comprise one or more first converging nozzles and the reamer section comprises one or more second converging nozzles axially spaced from the one or more first converging nozzles.

19. A method for forming a borehole extending through a subterranean earthen formation, the method comprising:

(a) pumping a drilling fluid comprising a plurality of solid impactors into a particle impact drill bit located within the borehole;

(b) ejecting the drilling fluid as a jet from a converging nozzle of a pilot section of the drill bit that is located centrally along a central axis of the drill bit whereby the jet, comprising the plurality of solid impactors, impacts a terminal end of the borehole to fluidically fracture the earthen formation; and (c) expanding the borehole by a reamer section of the drill bit located centrally along the central axis whereby the pilot section of the drill bit is spaced from the terminal end of the borehole as the jet impacts the terminal end of the borehole.

20. The method of claim 19, further comprising:

(d) ejecting the drilling fluid as a jet from a converging nozzle of the reamer section of the drill bit whereby the jet impacts a sidewall of the borehole.

21. The method of claim 19, wherein:

wherein the reamer section comprises a first reamer section of the drill bit;

the method further comprises:

(d) expanding the borehole by a second reamer section of the drill bit that is axially spaced from the first reamer section and which defines a maximum outer diameter of the drill bit.

22. The method of claim 21, further comprising:

(e) ejecting the drilling fluid as a jet from a converging nozzle of the second reamer section of the drill bit whereby the jet impacts a sidewall of the borehole.

23. A particle impact drill bit for forming a wellbore in an earthen formation, the drill bit comprising:

a central axis, a longitudinal first end, a longitudinal second end opposite the first end, and a feed passage extending into the drill bit from the second end;

one or more first converging nozzles in fluid communication with the feed passage for directing one or more first jets of drilling fluid comprising at least some of a plurality of solid impactors against a wall of the wellbore to fluidically fracture the earthen formation; and one or more second converging nozzles in fluid communication with the feed passage and axially spaced from the one or more first converging nozzles for directing one or more second jets of drilling fluid comprising at least some of the plurality of solid impactors against the wall of the wellbore to fluidically fracture the earthen formation, wherein at least one of the one or more first converging nozzles is oriented at an obtuse angle relative to at least one of the one or more second converging nozzles.

* * * * *